US011178951B2

(12) United States Patent
Penaflor et al.

(10) Patent No.: US 11,178,951 B2
(45) Date of Patent: Nov. 23, 2021

(54) MUSTACHE AND BEARD CARE TOOL

(71) Applicants: Ronaldo Green Penaflor, Fallbrook, CA (US); Ronaldo Narvaza Penaflor, Fallbrook, CA (US)

(72) Inventors: Ronaldo Green Penaflor, Fallbrook, CA (US); Ronaldo Narvaza Penaflor, Fallbrook, CA (US)

(73) Assignee: iP TECH PROS Inc., San Diego, CA (US)

( * ) Notice: Subject to any disclaimer, the term of this patent is extended or adjusted under 35 U.S.C. 154(b) by 373 days.

(21) Appl. No.: 16/252,659

(22) Filed: Jan. 20, 2019

(65) Prior Publication Data

US 2020/0229574 A1 Jul. 23, 2020

(51) Int. Cl.

| | |
|---|---|
| ***A45D 24/10*** | (2006.01) |
| ***A45D 42/16*** | (2006.01) |
| ***A45D 40/18*** | (2006.01) |
| ***A46B 9/02*** | (2006.01) |
| *B26B 13/00* | (2006.01) |

(52) U.S. Cl.

CPC ..... *A45D 24/10* (2013.01); *A45D 40/18* (2013.01); *A45D 42/16* (2013.01); *A46B 9/023* (2013.01); *A46B 9/025* (2013.01); *A45D 2200/25* (2013.01); *A46B 2200/104* (2013.01); *B26B 13/00* (2013.01)

(58) Field of Classification Search

CPC ..... A45C 11/008; A45C 11/007; A45D 24/08; A45D 24/10; A45D 24/36; A45D 24/16; A45D 2024/002

USPC ..... D3/205; D28/9

See application file for complete search history.

(56) References Cited

U.S. PATENT DOCUMENTS

| | | | | |
|---|---|---|---|---|
| 1,390,332 A * | 9/1921 | Bethincourt | A46B 15/0059 | 132/312 |
| 1,833,541 A | 11/1932 | Sierad et al. | | |
| 3,620,229 A * | 11/1971 | Friedman | A45D 24/08 | 132/119 |
| 3,877,472 A * | 4/1975 | D'Angelo | A45D 24/36 | 132/145 |
| 4,336,815 A * | 6/1982 | Ross | A45D 24/08 | 132/143 |
| 4,414,991 A * | 11/1983 | Marcotte | A45D 24/36 | 132/214 |
| 5,152,307 A * | 10/1992 | Schlaszus | A45C 11/24 | 132/289 |
| 5,320,125 A * | 6/1994 | Barnhart | A45D 40/18 | 132/297 |
| 6,206,010 B1 * | 3/2001 | Malki | A45D 24/00 | 132/102 |
| 6,510,856 B1 * | 1/2003 | Ahn | A41G 5/0086 | 132/126 |

(Continued)

*Primary Examiner* — Nicholas D Lucchesi

(57) ABSTRACT

A mustache and beard care tool having a compact, multi-functional and reusable device for managing and caring for facial beards. The mustache and beard care tool may include a housing, a comb holder slot formed on the housing, a lid detachably coupled to the housing, a semi-movable comb having a pivot handle and a pin, a fixed comb having a plurality of teeth equally distributed and formed on a portion of the lid, the plurality of comb channels is configured to receive the plurality of teeth of the fixed comb, a beard wax product and a beard brush assembly coupled to the bottom portion of the housing.

20 Claims, 36 Drawing Sheets

(56) References Cited

U.S. PATENT DOCUMENTS

| | | | | |
|---|---|---|---|---|
| 6,588,108 | B2 * | 7/2003 | Talavera | B26B 19/16 30/124 |
| 8,066,014 | B2 * | 11/2011 | Deris | A46B 15/0077 132/102 |
| 2015/0270862 | A1 * | 9/2015 | Harris | A45C 11/008 224/576 |
| 2018/0042358 | A1 * | 2/2018 | Wilson | A45D 24/10 |
| 2019/0110577 | A1 * | 4/2019 | McDonough | A45C 11/008 |
| 2019/0246764 | A1 * | 8/2019 | Ott | A45D 24/04 |
| 2019/0313762 | A1 * | 10/2019 | Maor | A45D 24/32 |

* cited by examiner

MUSTACHE AND BEARD CARE TOOL

FIELD OF THE INVENTION

The present invention relates to a portable and multipurpose facial hair grooming and hair care device. Particularly, the multipurpose facial hair grooming and hair care device provides a compact, multifunctional and reusable tool for styling, managing and caring for mustaches and beards.

BACKGROUND

Mustache and beard grooming kits are generally popular among those who desire to maintain their moustache and beards on a regular basis. These grooming kits include, for example, bottles of mustache or beard portions, bottles of mustache or beard shampoos, moisturizers, brushes, combs, scissors or clipper, and many other mustache or beard products.

One such grooming device is exemplified by a "Beard Grooming & Trimming Kit for Men Care", including separately items such as a Beard Brush, Beard Comb, Unscented Beard Oil Leave-in Conditioner, Mustache & Beard Balm Butter Wax stuffers, Barber Scissors for stocking, Growth Gift set sold on Amazon (https://www.amazon.com/Beard-Grooming-Trimming-Care-Leave/dp/B071RTF9HN/ref=sr_1_2_s_it?s=beauty&ie=UTF8&qid=1547799018&sr=1-2-spons&keywords=beard+kit&psc=1), incorporated by reference herein in its entirety.

Another beard grooming device is exemplified by a beard grooming stick sold on Amazon (https://www.amazon.com/Beard-Grooming-Styling-Stick-Types/dp/B077ZXNGLW/ref=asc df B077ZXNGLW/?tag=hyprod-20&linkCode=dfO&hvadid=312065476237&hvpos=lol&hvnetw=g&hvrand=13340317642385644996&hvpone=&hvptwo=&hvqmt=&hvdev=c&hvdvcmd1=&hvlocint=&hvlocphy=9031297&hvtargid=pla-570287179883&psc=l&tag=&ref=&adgrpid=65836846521&hvpone=&hvptwo=&hvadid=312065476237&hvpos=lol&hvnetw=g&hvrand=13340317642385644996&hvqmt=&hvdev=c&hvdvcmd1=&hvlocint=&hvlocphy=9031297&hvtargid=pla-570287179883), incorporated by reference herein in its entirety. This item generally includes a beard styling product that is fitted in a container having a push-up and pull-down mechanism and adjustable knob similar to that of a deodorant stick.

Though the beard grooming products presented above may have some desirable features, it is still lacking in other areas that may be beneficial to individual having to care and maintain their mustaches or beards.

SUMMARY

It is an advantage of the present invention to provide a mustache and beard care tool for grooming, maintaining and caring for a mustache or beard of a user, the mustache and beard care tool including a housing having a wall enclosure and a bottom portion, where a cavity is formed within the wall enclosure and the bottom portion, a protruding lip formed at a top portion of the housing, and a comb holder slot formed in the wall enclosure and along an exterior edge portion of the housing, the bottom portion includes a hole centrally positioned at the bottom portion of the housing; a lid detachably coupled to the protruding lip of the housing; a semi-movable comb having a pivot handle and a pin, the semi-movable comb is coupled to the lid via the pin, the semi-movable comb is configured to fit into the comb holder slot of the housing when the lid is attached to the housing; a beard wax product coupled to an inner portion of the wall enclosure inside the cavity, the beard wax product is composed of a solid wax or a paste material for sculpting or shaping the mustache or beard of the user; a wax dispense assembly, where a portion of the wax dispense assembly is coupled to the beard wax product, the wax dispense assembly includes a control mechanism for dispensing and retracting the beard wax product; and a beard brush assembly coupled to the bottom portion of the housing.

It is another advantage of the present invention to provide a mustache and beard care tool for grooming, maintaining and caring for a mustache or beard of a user, the mustache and beard care tool having a housing having a wall enclosure and a bottom portion, where a cavity is formed within the wall enclosure and the bottom portion, a protruding lip formed at a top portion of the housing, a comb holder slot formed in the wall enclosure and along an exterior edge portion of the housing, the bottom portion includes a hole centrally positioned at the bottom portion of the housing, and a plurality of comb channels formed on an exterior surface of the housing; a lid detachably coupled to the protruding lip of the housing; a semi-movable comb having a pivot handle and a pin, the semi-movable comb is coupled to the lid via the pin, the semi-movable comb is configured to fit into the comb holder slot of the housing when the lid is attached to the housing; a fixed comb having a plurality of teeth equally distributed and formed on a portion of the lid, the plurality of comb channels is configured to receive the plurality of teeth of the fixed comb; a beard wax product coupled to an inner portion of the wall enclosure inside the cavity, the beard wax product is composed of a solid wax or a paste material for sculpting or shaping the mustache or beard of the user; a wax dispense assembly, where a portion of the wax dispense assemble is coupled to the beard wax product, the wax dispense assembly includes a control mechanism for dispensing and retracting the beard wax product; and a beard brush assembly coupled to the bottom portion of the housing.

In one embodiment, the semi-movable comb may include a pivot handle coupled to an elongated rectangular shaft having a single row of teeth, the single row of teeth formed along a length-wise edge of the elongated rectangular shaft.

In another embodiment, the single row of teeth of the semi-movable comb may include a narrow size set of teeth, a medium size set of teeth, or a large size set of teeth.

In yet another embodiment, the wax dispense assembly may include a threaded wax dispensing rod having a bottom section and a series of threads along a lengthwise portion of the threaded wax dispensing rod, a wax dispensing support platform coupled to the series of threads of the threaded wax dispensing rod, and a wax dispensing controller coupled to the bottom section of the threaded wax dispensing rod.

It still yet another embodiment, the beard brush assembly may be connected to the wax dispensing controller and configured to rotate, the beard brush assembly takes control of the control mechanism for dispensing and retracting the beard wax product by rotating the beard brush assembly in either a clockwise or counterclockwise direction.

In one aspect, the housing may include two curved sides, the two curved sides having a smooth wave-like shape that is configured to conform to a grip of a hand of the user.

In another aspect, the beard brush assembly may include a brush handle and a plurality of short teeth coupled to the brush handle.

In one implementation, a mirrored surface may be applied to a front face portion of the housing.

In another implementation, the housing may include a scissors compartment formed on an exterior surface of the housing and configured to hold a pair of scissors.

In yet another implementation, the mustache and beard care tool may be a disposable product having non-replaceable components.

In still yet another implementation, the mustache and beard care tool may be a non-disposable product having replaceable or interchangeable components, including replaceable beard wax products, replaceable or interchangeable comb sizes and types, replaceable or interchangeable brush assemblies, and replaceable or interchangeable lid assemblies.

In another embodiment, each tooth of the plurality of teeth may be shaped to be complementary to a shape of each comb channel of the plurality of comb channels.

Some advantages of the mustache and beard care tool include 1) ease of use of applying beard wax, styling, and grooming the beard and mustache 2) all-in-one tool for applying beard wax, styling, and grooming the beard and mustache; 3) slim profile having an ergonomic and comfortable grip; 4) light-weight, compact and portable to carry (i.e., travel size); and 5) replaceable beard wax products, replaceable or interchangeable comb sizes and types, replaceable or interchangeable brush assemblies, and replaceable or interchangeable lid assemblies.

These and other objects, features and advantages of the present invention will become more apparent in light of the following detailed description of preferred embodiments thereof, as illustrated in the accompanying drawings.

BRIEF DESCRIPTION OF THE DRAWINGS

The present invention will be more clearly understood from the following detailed description of the preferred embodiments of the invention and from the attached drawings, in which.

In the appended figures, one or more elements may have the same reference numeral in different figures indicating previously described elements.

DETAILED DESCRIPTION

Embodiments in this disclosure include a novel mustache and beard care device for grooming, caring and maintaining thereof.

Unlike the conventional beard kits available on the market which typically sell brushes, combs, and beard wax in a kit as separate items, the novel mustache and beard care device includes a unified, simple, portable, multipurpose, and versatile device, making it less expensive and simple to manufacture, and advantageous and a key distinction over conventional beard kits. In the examples presented below, the novel mustache and beard care device generally is applicable to mustaches and beards which may also include sideburns and goatees or any combination of mustaches, goatees, beards, or sideburns.

Figure 1:
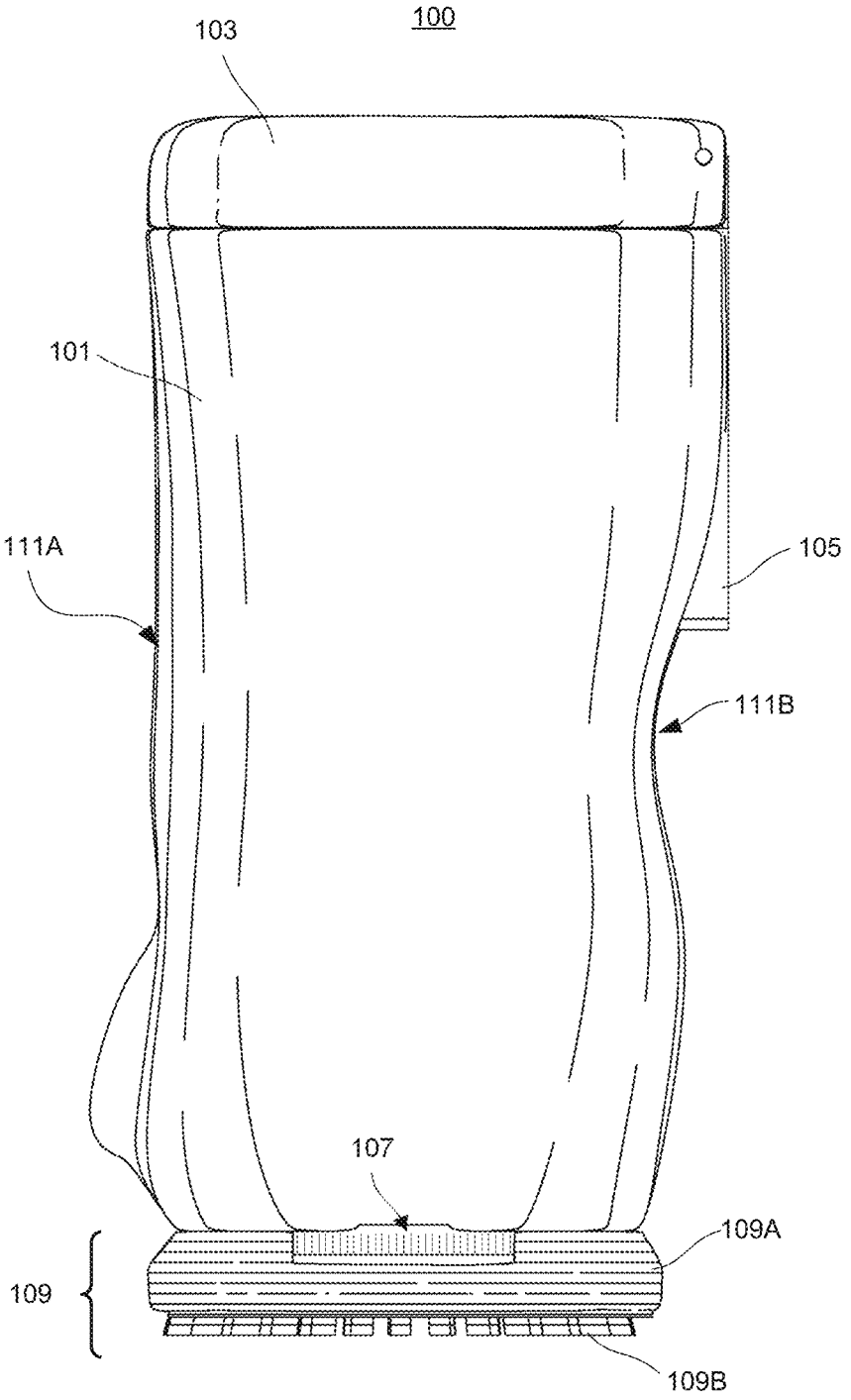
FIG. 1 illustrates a front view of a mustache and beard care tool for grooming, caring and maintaining a mustache or beard of a user, in accordance with an embodiment.

FIG. 1 illustrates a front view of a mustache and beard care tool 100 for grooming, caring and maintaining a mustache or beard of a user according to an embodiment. The mustache and beard care tool 100 includes a housing 101, a lid 103 (or top cover) coupled to a top portion of the housing 101, a comb holder slot 105 having a narrow channel formed in a wall enclosure (not shown) along an exterior and upper side edge portion of the housing 101 and another wall enclosure (not shown) along an exterior side edge portion of the lid 103, a semi-movable comb (not shown in this figure but shown in subsequent figures) coupled to the lid 103 and configured to fit in the comb holder slot 105, a wax dispensing controller 107 coupled to a bottom portion of the housing 101, and a beard brush assembly 109. The housing 101 is generally a container or cuplike object having enclosed sidewalls, a bottom side that is also enclosed, and a cavity formed within the wall enclosure and the bottom portion of the housing and an opening of the cavity formed at the top portion of the housing 101. In one implementation, the housing 101 may be made in the shape of an elliptic cylinder having a smooth, contoured and non-linear (or curved) sides or edges (111A, 111B). In practice the smooth and curved sides or edges (111A, 111B) of the housing 101 akin to a smooth wave-like shape that is configured to match and conform to a grip of a hand of the user when held by the user, providing an ergonomic and comfort to the hand of the user. In another implementation, the beard brush assembly 109 may include a brush handle 109A and a plurality of short teeth 109B coupled to the brush handle 109A.

Figure 2:
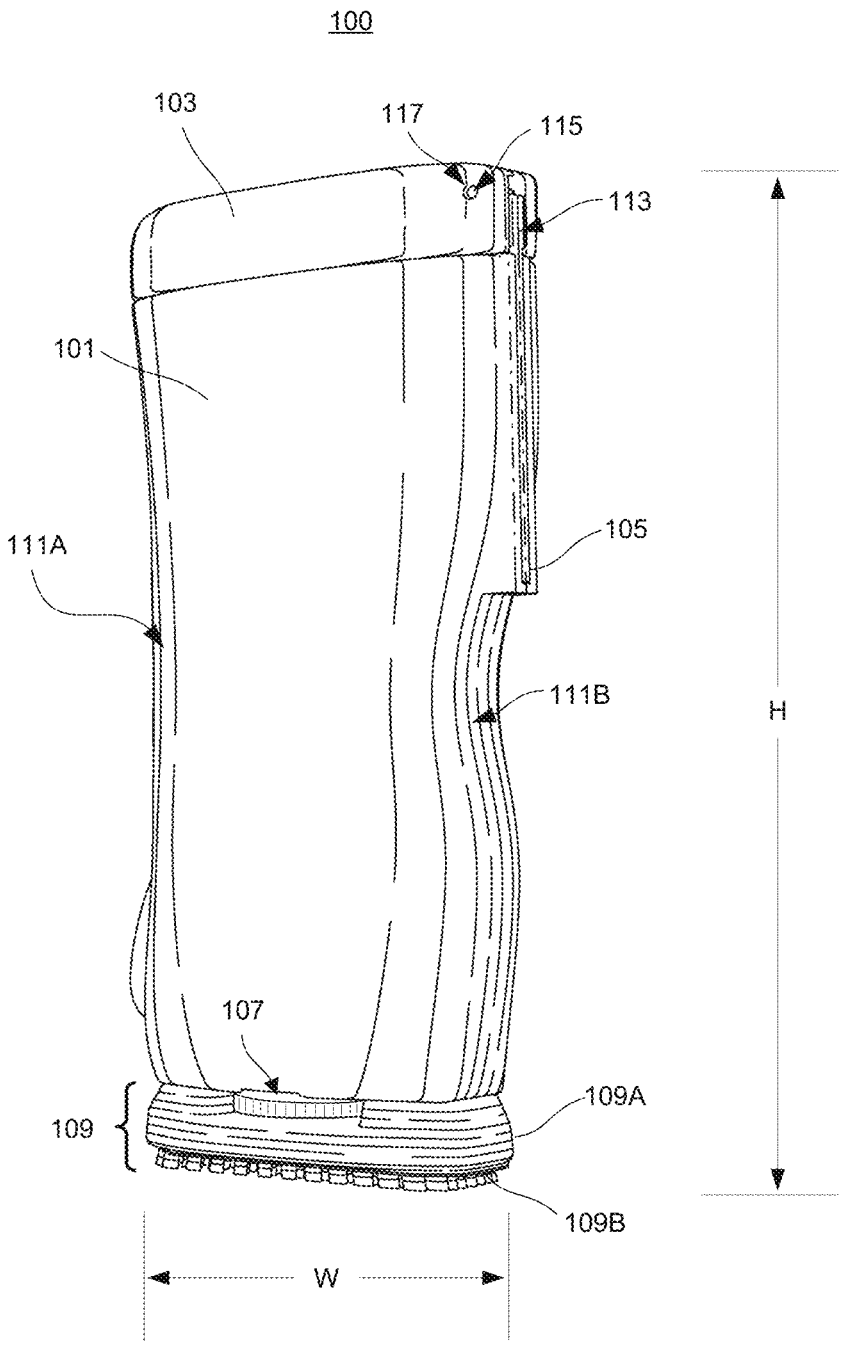
FIG. 2 illustrates a front perspective view of the mustache and beard care tool, in accordance with an embodiment.

FIG. 2 illustrates a front perspective view of the mustache and beard care tool 100. In this illustration, the semi-movable comb 113 (as partially shown) is inserted into the comb holder slot 105 and held by a pin 115 that is supported by a couple of holes 117 formed in the lid 103. In practice, since the mustache and beard care tool 100 is intended to be held by the hand of the user, typical dimensions of the mustache and beard care tool 100 are between 0.5"-3" in width (W), 2.0"-6" in height (H), and 0.5"-1" in depth (D).

Figure 3A:
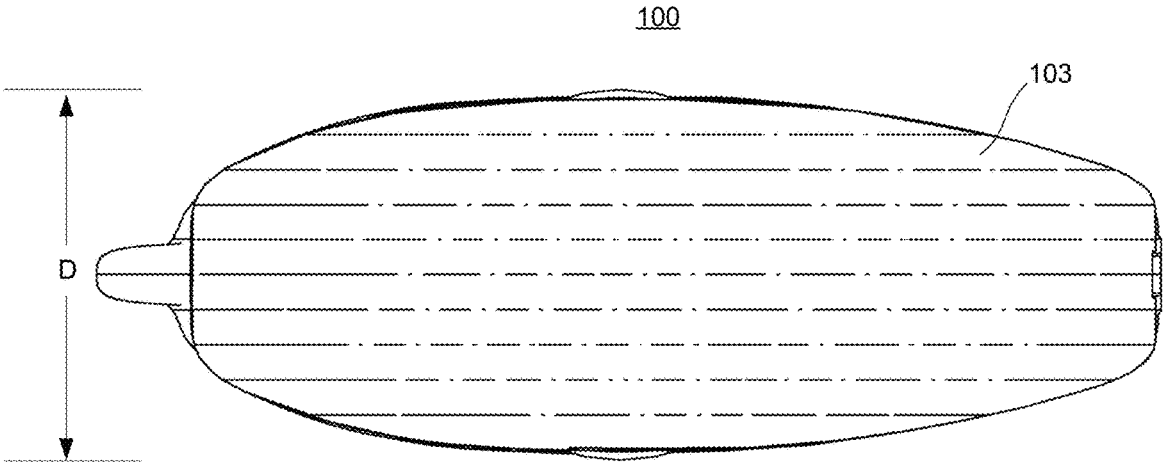
FIG. 3A and FIG. 3B illustrate a top view and bottom view, respectively, of the mustache and beard care tool, in accordance with an embodiment.
Figure 3B:
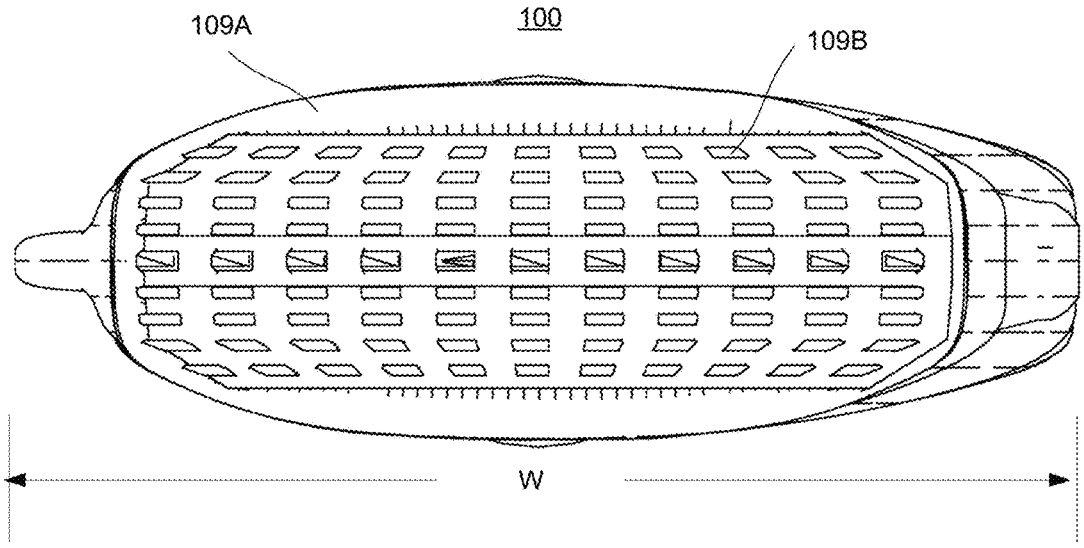

FIG. 3A and FIG. 3B illustrate a top view and bottom view, respectively, of the mustache and beard care tool 100. In this illustration, the lid 103 and beard brush assembly 109 are shown to both have similar shapes and generally in the shape of an elliptic cylinder, matching the housing 101. Also, a full view of the plurality of short teeth 109B coupled to the brush handle 109A is provided in FIG. 3B, showing a series of the rows, placement, and distribution of the short teeth 109B formed on the brush handle 109A.

Figure 4A:
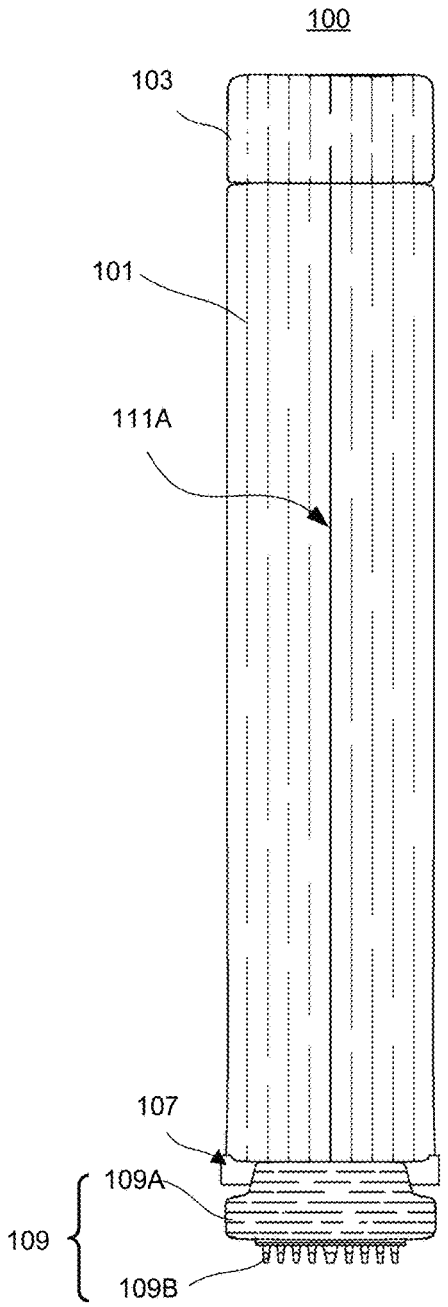
FIG. 4A and FIG. 4B illustrate a left side view and right side view, respectively, of the mustache and beard care tool, in accordance with an embodiment.
Figure 4B:
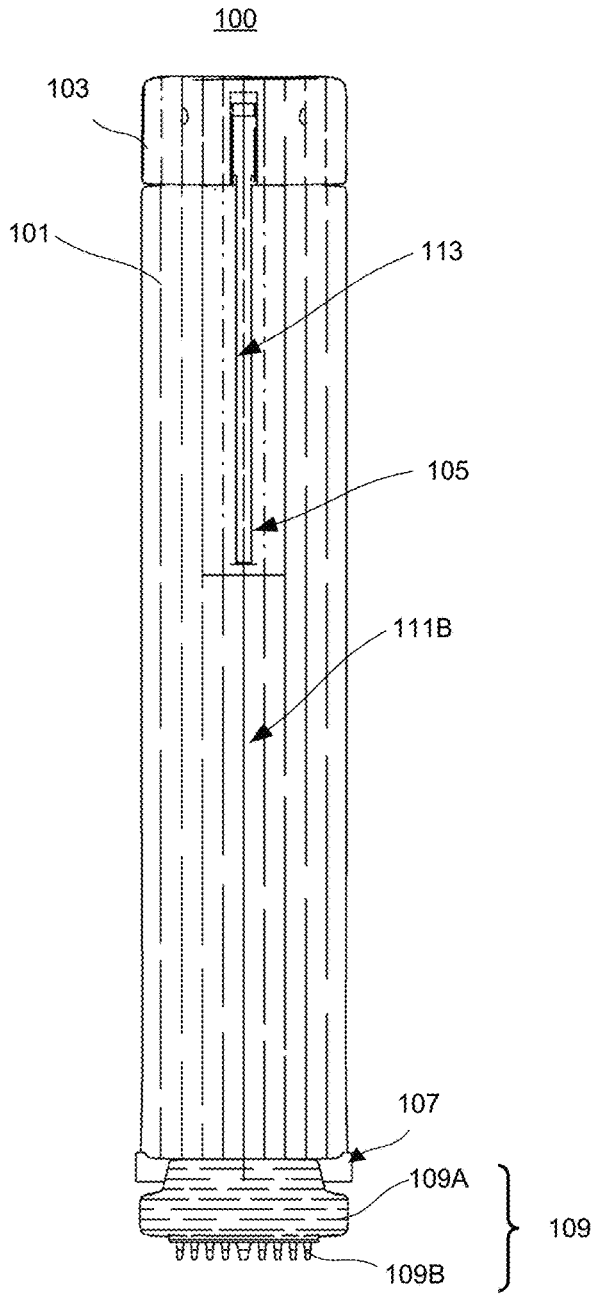

FIG. 4A and FIG. 4B illustrate a left side view and right side view, respectively, of the mustache and beard care tool 100. In these side view illustrations, the housing 101 is shown as having a long and narrow body. These side view illustrations also provide the relative positions and dimensions between the housing 101, the lid 103, the comb holder slot 105, the semi-movable comb 113, the controller 107 and beard brush assembly 109.

Figure 5:
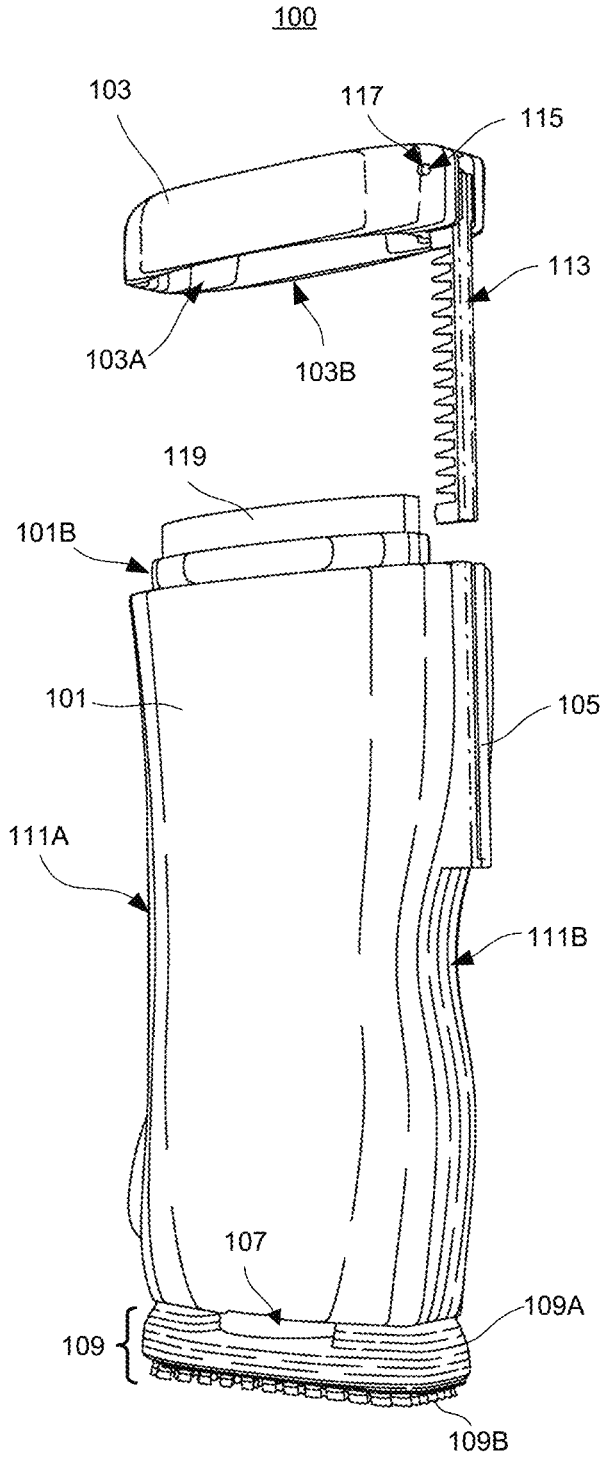
FIG. 5 illustrates a perspective view of the mustache and beard care tool with the lid detached from the housing, in accordance with an embodiment.

FIG. 5 illustrates a perspective view of the mustache and beard care tool 100 with the lid 103 detached from the housing 101. In this illustration, the semi-movable comb 113 is exposed and includes a rectangular strip having a single row and narrow size set of teeth. The mustache and beard care tool 100 may also include a beard wax product 119 coupled to a cavity (not shown) formed in an interior portion of the housing 101, the beard wax product 119 projecting out of a protruding support lip 101B formed on top of the housing 101 as shown with the lid 103 removed. The lid 103 includes cavity 103A defined by an interior lid wall enclosure 103B formed in an interior portion of the lid 103 that is structurally shaped and configured to match and mate with the protruding support lip 101B of the housing 101, allowing the lid 103 to be easily attached and detached from the protruding support lip 101B of the housing 101. In practice, the cavity 103A allows additional space to receive a top portion of the beard wax product 119 protruding from the top portion of the housing 101.

Figure 6:
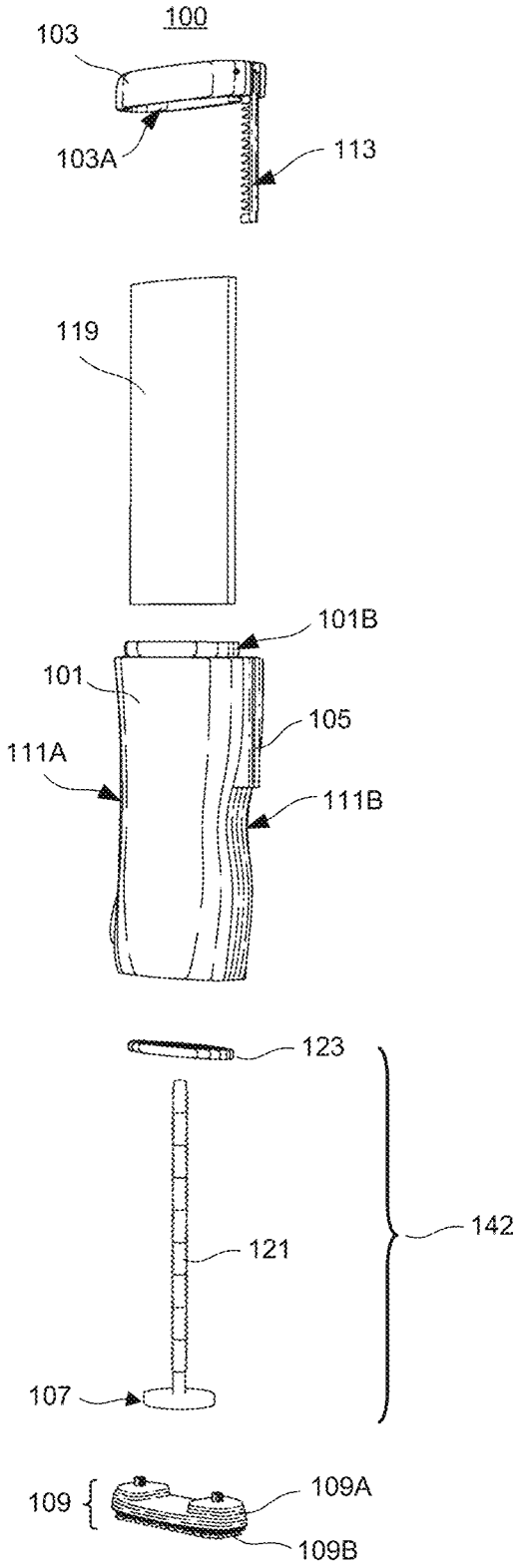
FIG. 6 illustrates an exploded view of the mustache and beard care tool in accordance, in accordance with an embodiment.

FIG. 6 illustrates an exploded view of the mustache and beard care tool 100 in accordance to an embodiment. Several hidden elements of the mustache and beard care tool 100 are made visible in this illustration. For example, the mustache and beard care tool 100 may also include a threaded wax dispensing rod 121 coupled to the wax dispensing controller 107, and a wax dispensing support platform 123 coupled to the threaded wax dispensing rod 121, providing support for the beard wax product 119. In operation, a wax dispense assembly 142 including the threaded wax dispensing rod 121, the wax dispensing support platform 123, and wax dispensing controller 107 together act as a push-up and pull-down mechanism which is controlled by the wax dispensing controller 107 for dispensing or retracting the beard wax product 119.

Figure 7A:
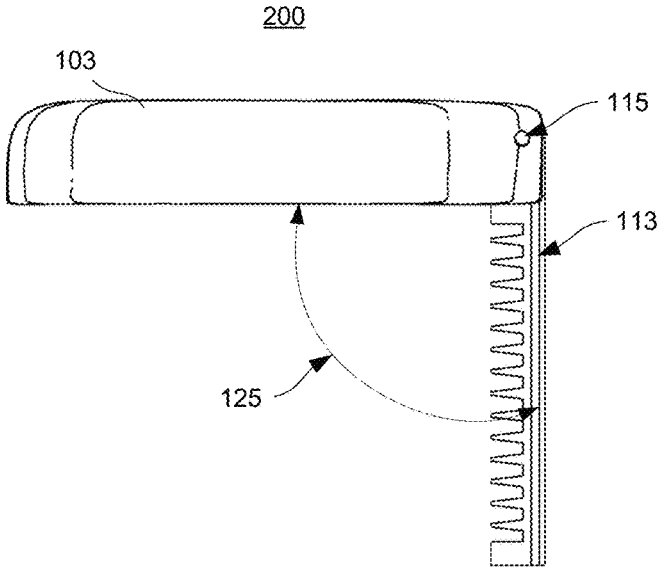
FIG. 7A-FIG. 7C illustrate multiple configurations of the lid and semi-movable comb which together forms a lid-comb assembly, in accordance to an embodiment.
Figure 7B:
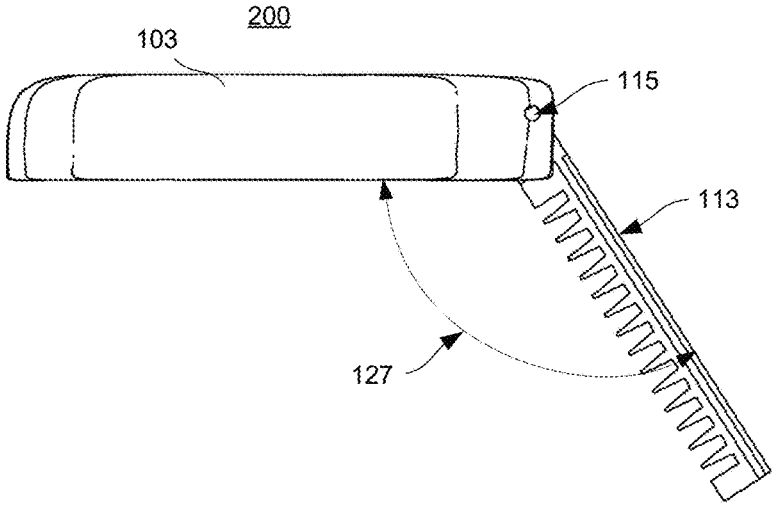
Figure 7C:
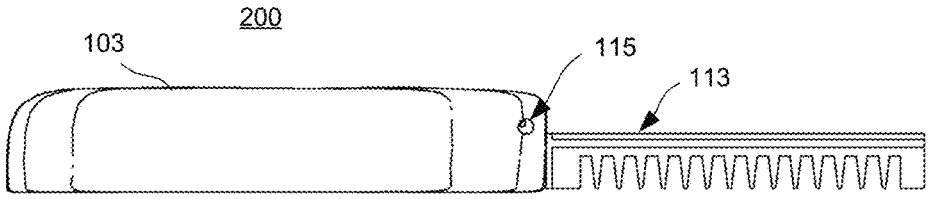

FIG. 7A-FIG. 7C illustrate multiple configurations of the lid 103 and semi-movable comb 113 which together forms a lid-comb assembly 200 in accordance to an embodiment. In a first configuration, as shown in FIG. 7A, the lid-comb assembly 200 is shown in its default position after being removed from the housing 101. In this initial configuration, an angle 125 of approximately 90 degrees is formed between a length-wise edge of the semi-movable comb 113 and a length-wise edge of the lid 103. In a second configuration, as shown in FIG. 7B, the lid-comb assembly 200 is shown in an intermediate position, having an angle 127 formed between the length-wise edge of the semi-movable comb 113 and the length-wise edge of the lid 103 that is greater than 90 degrees but less than 180 degrees. In this example, the pin 115 serves as a pivot point by which the semi-movable comb 113 is rotated. In a third and final configuration, as shown in FIG. 7C, the lid-comb assembly 200 is shown in a fully open position, having the length-wise edge of the semi-movable comb 113 in-line and horizontally parallel with the length-wise edge of the lid 103. In practice, the lid 103 may serve as a handle of the lid-comb assembly 200 when detached from the housing 101.

Figure 8B:
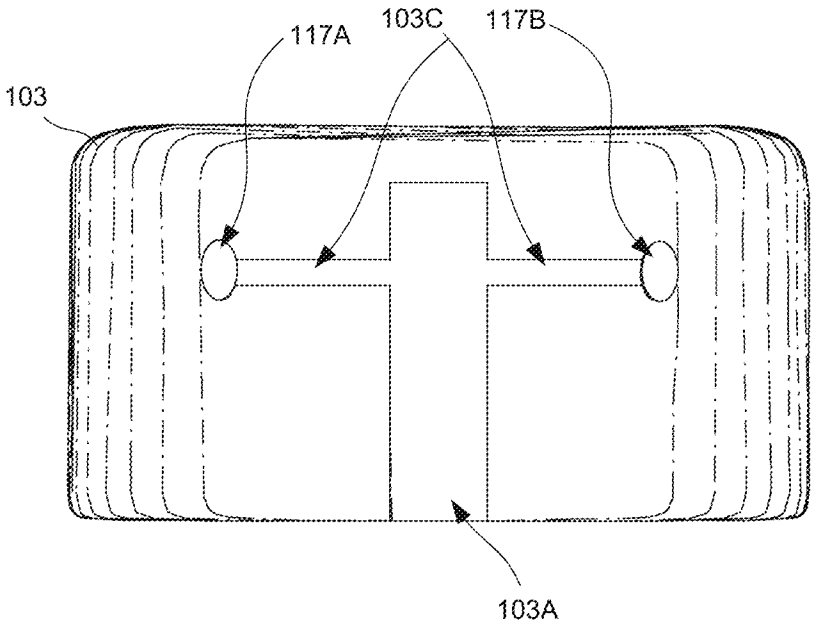
FIG. 8A and FIG. 8B illustrate a perspective view of the semi-movable comb and a front view of the lid, respectively in accordance to an embodiment.
Figure 8A:
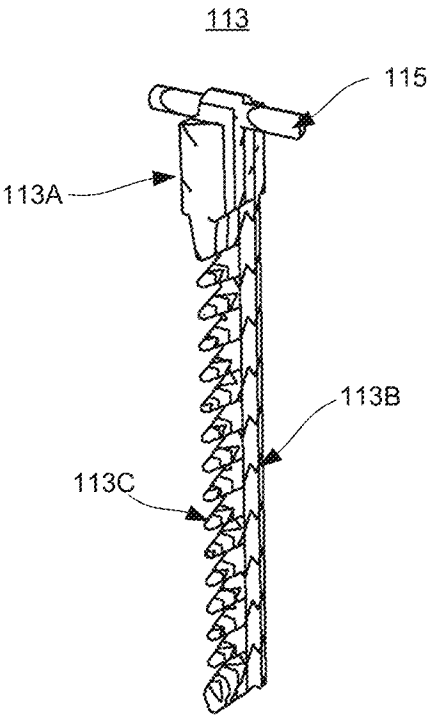

FIG. 8A and FIG. 8B illustrate a perspective view of the semi-movable comb 113 and a front view of the lid 103, respectively in accordance to an embodiment. In FIG. 8A, the semi-movable comb 113 may include a pivot handle 113A coupled to an elongated rectangular shaft 113B having a single row of teeth 113C, the single row of teeth 113C formed along a length-wise edge of the rectangular shaft 113B. In addition, one end of the pivot handle 113A opposite to the pin 115 may be joined to a connecting end of the rectangular shaft 113B. Referring to FIG. 8B, holes (117A, 117B) are formed on each side of the lid 103 and are configured to receive and hold the pin 115 which is used to secure the semi-movable comb 113 to the lid 103. The lid 103 may also have a pivot handle channel 103A and a pin channel 103C providing a narrow slot for receiving and supporting the pivot handle 113A and pin 115, respectively. In application, the semi-movable comb 113 may be attached to the lid 103 by snapping the pin 115 into the pin channel 103C. This method is generally accomplished by aligning the pin 115 into the narrow slot and then applying pressure and pushing the pivot handle 113A towards the lid 103. Removing the semi-movable comb 113 from the lid 103 is accomplished by using a slight force to pull the pivot handle 113A of the semi-movable comb 113 away from the lid 103. In one advantage, the ability to attach and remove the semi-movable comb 113 to and from the lid 103 provides the user the benefit of swapping combs with a replacement comb should it get damaged or swapping it with another type of comb having a different size, style, or comb teeth for different grooming purposes.

Figure 9A:
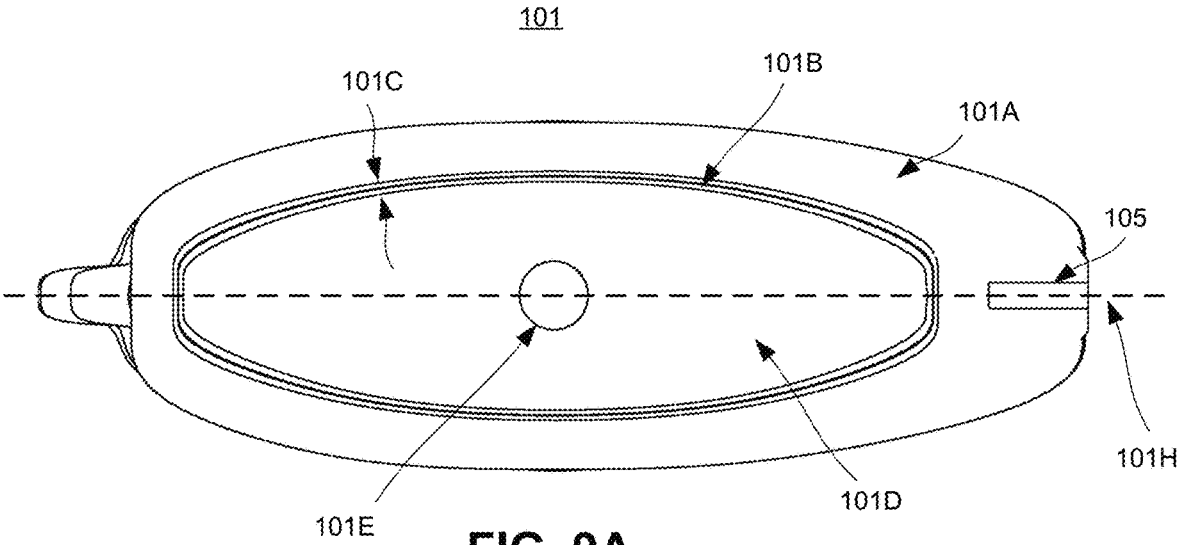
FIG. 9A and FIG. 9B illustrate a top and a bottom view, respectively, of the housing according to an embodiment.
Figure 9B:
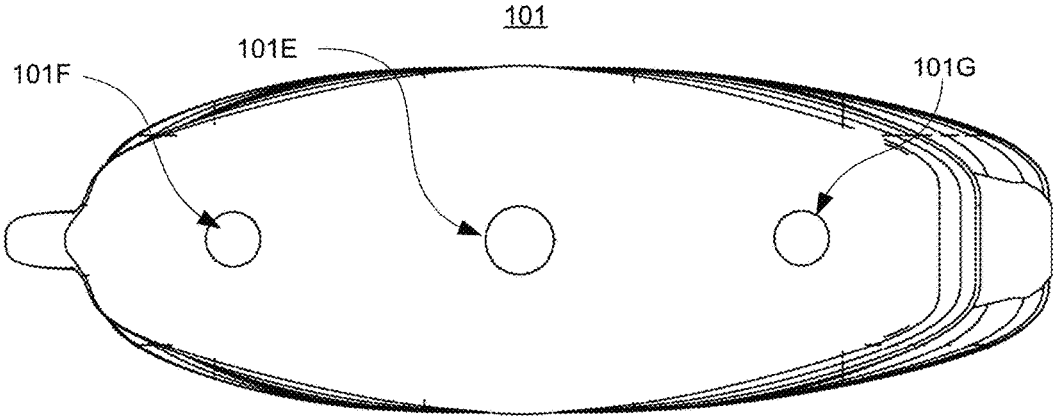

FIG. 9A and FIG. 9B illustrate a top and a bottom view, respectively, of the housing 101 according to an embodiment. In FIG. 9A, additional elements of the housing 101 are visible from top view and with the lid 103 removed. For example, the housing 101 may include a wall enclosure 101A having an oval shape and a predetermine thickness, defining the structure of the housing 101. In addition, the protruding support lip 101B of housing 101 is shown in this illustration to include a narrow wall 101C which is generally oval in shape and generally matching the shape of the wall enclosure 101A. The housing 101 may also include a cavity 101D formed within an interior portion of the housing 101 for receiving and housing the beard wax product 119. As shown in the top view of FIG. 9A, a housing dispensing rod hole 101E is formed at a bottom portion of the housing 101 and centrally positioned to the protruding support lip 101B. In practice, the housing dispensing rod hole 101E of the housing 101 provides an opening into which the threaded wax dispensing rod 121 is inserted. Also shown in this drawing is the comb holder slot 105 of the housing 101 which is defined by a narrow channel that is formed in the wall enclosure 101A. In addition, the comb holder slot 105 has a first centerline that coincides with a second centerline defined by the housing 101 (overlapping at the dashed lines 101H).

Now referring to FIG. 9B, additional elements of the housing 101 are also visible from bottom view and with the beard brush assembly 109 removed. In addition to the housing dispensing rod hole 101E of the housing 101, two circular shallow wells (101F, 101G) are included at the bottom of the housing 101 being horizontally aligned with the housing dispensing rod hole 101E. In some applications, the two circular shallow wells (101F, 101G) may allow for additional support and stability when securing the beard brush assembly 109 to the bottom portion of the housing 101 as shown later herein below.

Figure 10A:
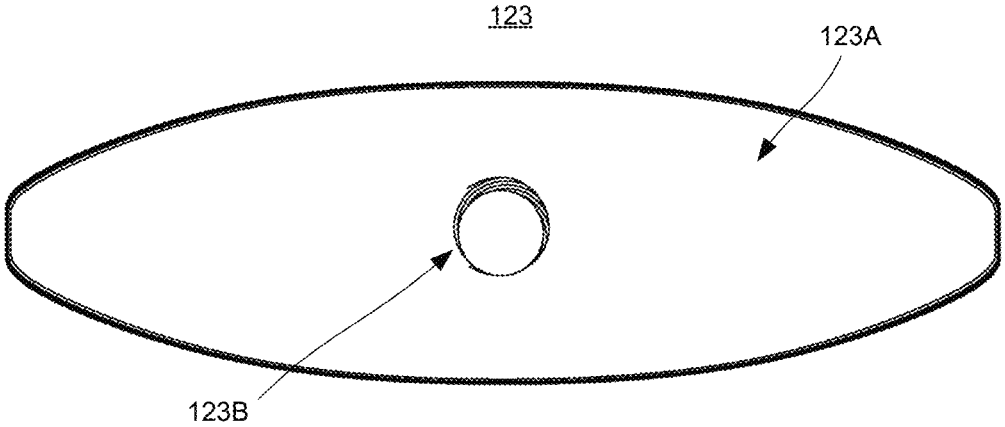
FIG. 10A-FIG. 10C illustrate a top, a side, and a perspective view, respectively, of the wax dispensing support platform according to an embodiment.
Figure 10B:
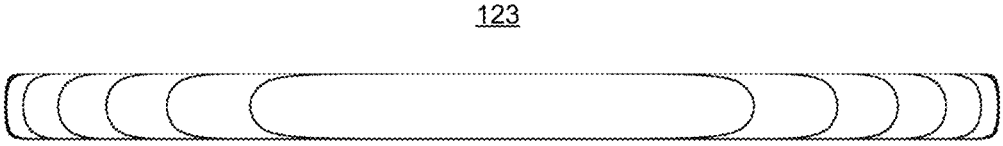
Figure 10C:
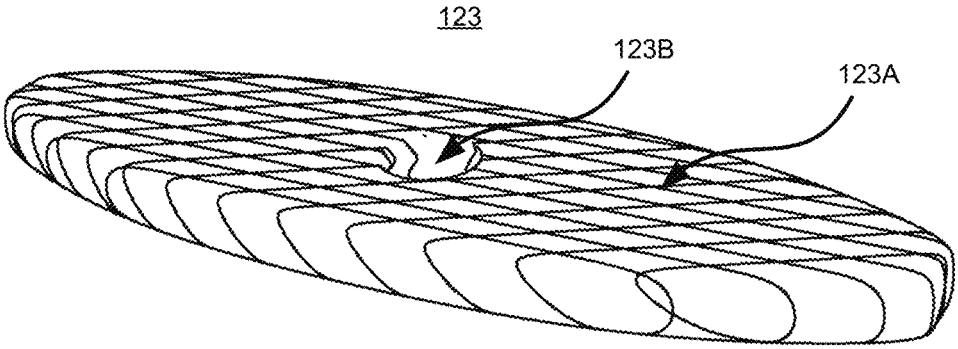

FIG. 10A-FIG. 10C illustrate a top, a side, and a perspective view, respectively, of the wax dispensing support platform 123 according to an embodiment. In FIG. 10A-FIG. 10C, the wax dispensing support platform 123 may include a pad structure 123A that is generally oval in shape and thin, having a platform dispensing rod hole 123A that is centrally position to the pad structure 123A. In one application, an edge defining the platform dispensing rod hole 123A may include threaded grooves for receiving a threaded screw such as the threaded wax dispensing rod 121.

Figure 11D:
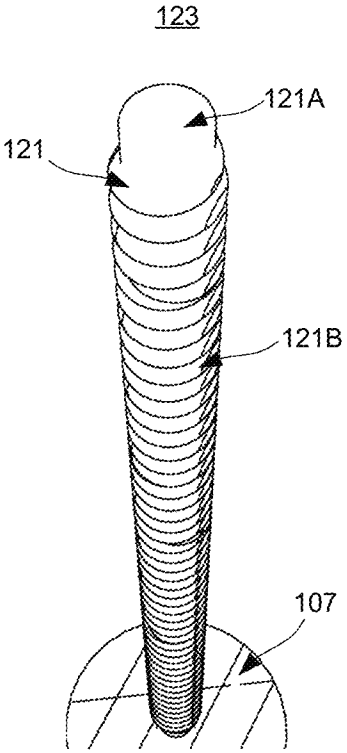
FIG. 11A-FIG. 11D illustrate a side, a top, a bottom, and a top perspective view, respectively, of the threaded wax dispensing rod and the wax dispensing controller according to an embodiment.
Figure 11C:
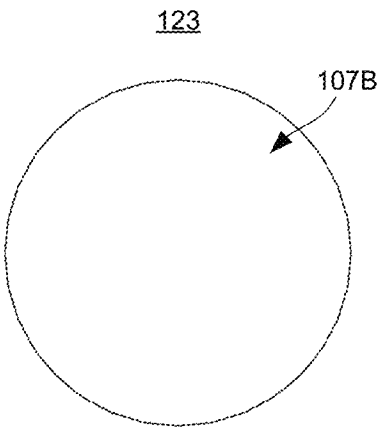
Figure 11B:
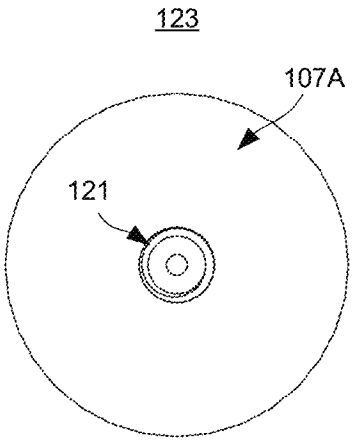
Figure 11A:
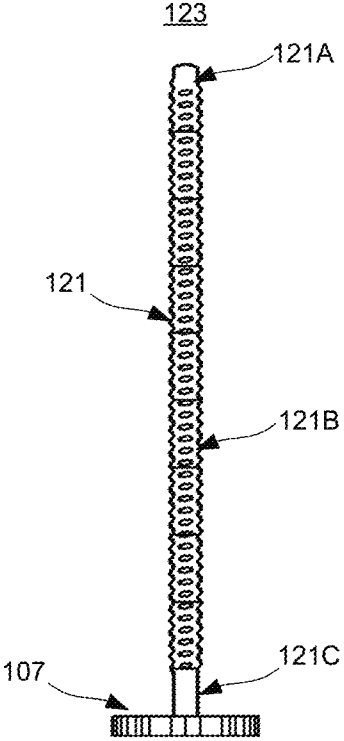

FIG. 11A-FIG. 11D illustrate a side, a top, a bottom, and a top perspective view, respectively, of the threaded wax dispensing rod 121 and the wax dispensing controller 107 according to an embodiment. As shown in FIG. 11A-FIG. 11D, the threaded wax dispensing rod 121 may include an unthreaded top portion 121A, a threading portion 121B, and an unthreaded bottom portion 121C. The threading portion 121B is generally formed along a lengthwise edge of the threaded wax dispensing rod 121. The threaded wax dispensing rod 121 may be connected to a top portion 107A and centered to the wax dispensing controller 107 (i.e., center of circle as shown in FIG. 11B). The wax dispensing controller 107 may also include a bottom portion 107B that is generally flat and smooth. In one instance, the threaded wax dispensing rod 121 and the wax dispensing controller 107 are joined together using a fastener or adhesive. In another instance, the threaded wax dispensing rod 121 and the wax dispensing controller 107 are formed as a single unitary piece using a single mold through an injection molding process or single print object using 3D printer technology.

Figure 12B:
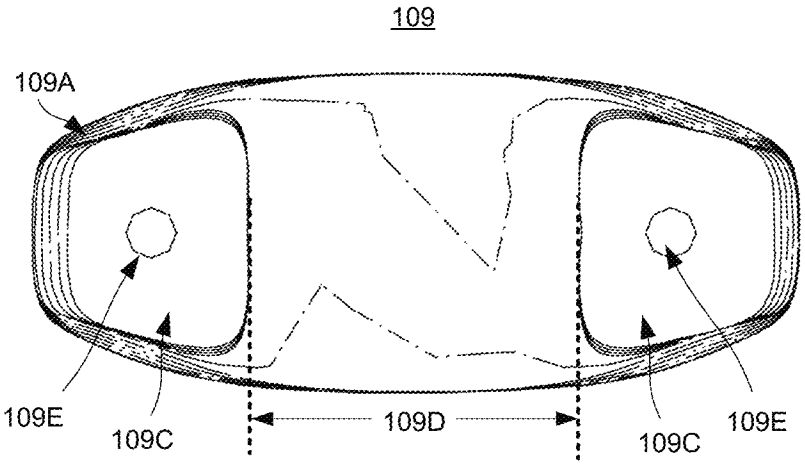
FIG. 12A-FIG. 12D illustrate a bottom, a top, a side, and a top perspective view, respectively, of the beard brush assembly including the brush handle and the plurality of short teeth according to an embodiment.
Figure 12D:
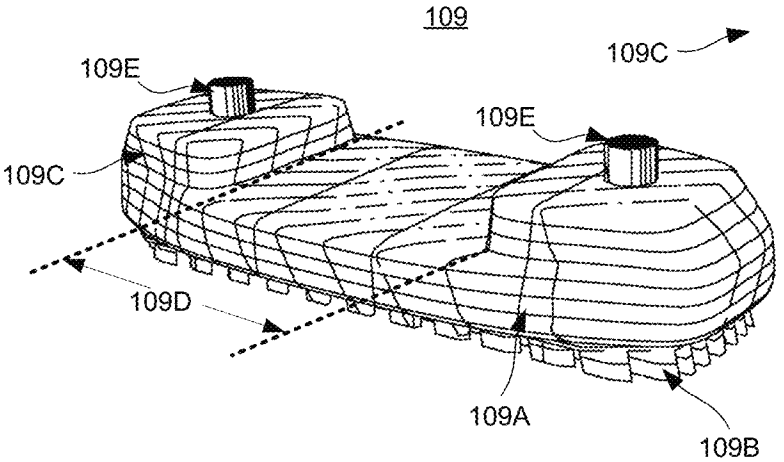
Figure 12A:
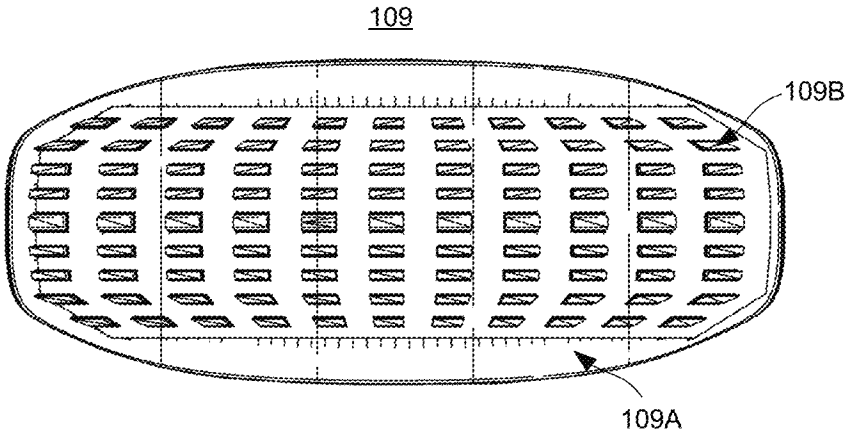
Figure 12C:
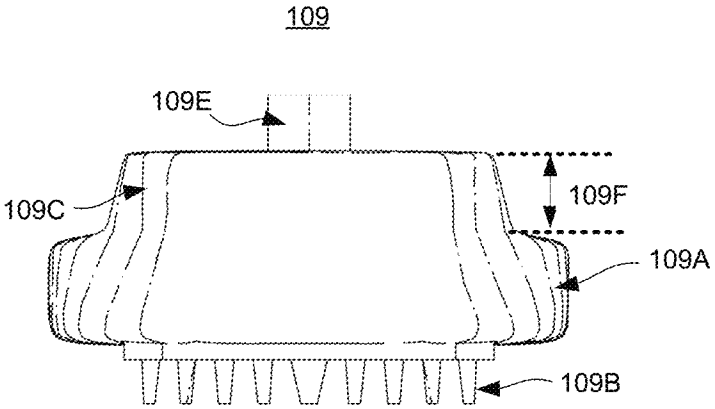

FIG. 12A-FIG. 12D illustrate a bottom, a top, a side, and a top perspective view, respectively, of the beard brush assembly 109 including the brush handle 109A and the plurality of short teeth 109B according to an embodiment. As shown in FIG. 12A, the plurality of short teeth 109B is uniformly distributed across the bottom portion of the brush handle 109A, forming a dense array of teeth used to disentangle, comb, or groom hair of the mustache or beard of the user. A pair of raised posts 109C are coupled to each end of the brush handle 109A and separated by a gap 109D as shown in FIG. 12B and FIG. 12D. Each raised post 109C may also include a support peg 109E used to support, secure and fasten the beard brush assembly 109 to corresponding holes formed in the housing 101 as shown in FIG. 12B-FIG. 12D. In FIG. 12C, the gap 109D includes a gap height 109F determined by the height of each post 109C, forming a depression in the beard brush assembly 109 which is used to allow adequate space for the wax dispensing controller 107 when the mustache and beard care tool 100 is fully assembled.

Figure 13A:
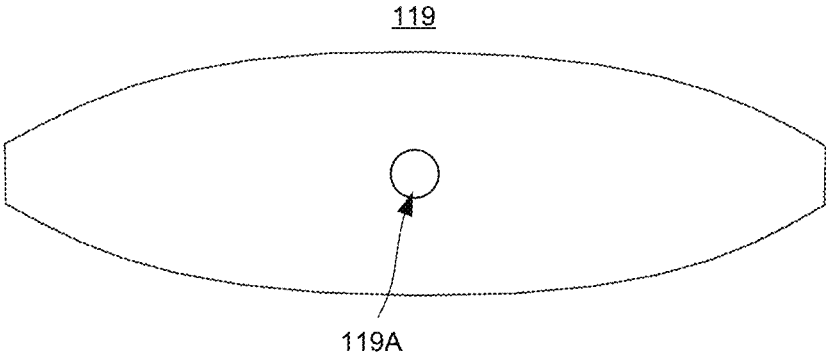
FIG. 13A-FIG. 13C illustrate a top (visually same as bottom), a side, and a perspective view, respectively, of the beard wax product according to an embodiment.
Figure 13B:
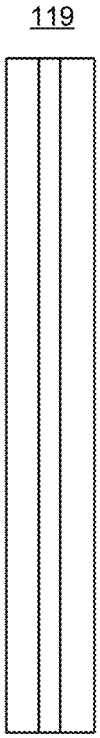
Figure 13C:
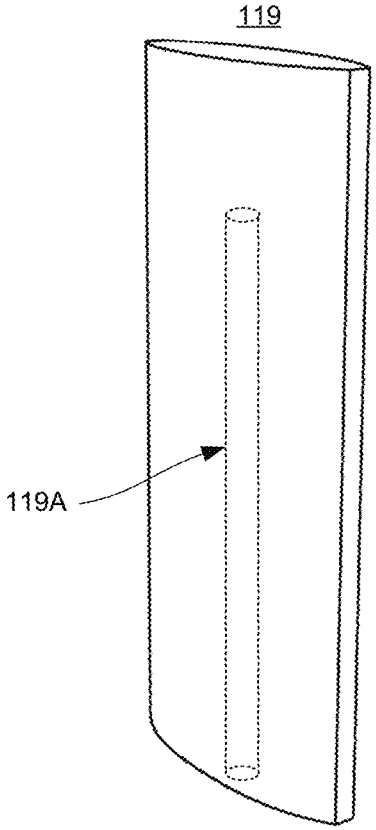

FIG. 13A-FIG. 13C illustrate a top (visually same as bottom), a side, and a perspective view, respectively, of the beard wax product 119 according to an embodiment. In these illustrations, the beard wax product 119 is a solid wax material having a shape of an oval or elliptic cylinder which is configured to match an interior portion of the housing 101. In other applications, the beard wax product 119 may configured using other shapes such as cylinders, hyperrectangles, cones, and the like in order to fit and match the shape of the interior portion of the housing 101. In practice, the beard wax product 119 may include solid wax or paste-like materials that are composed of ingredients designed to care, manage and groom the mustache and beard of the user. Some beard wax based material and ingredients may include, for example, a combination of bees wax, coconut oil, jojoba oil, butter, and other oils and fragrances. Also shown in FIG. 13A and FIG. 13C is a cylindrical hole 119A formed in the center of the beard wax product 119 and extending to the bottom thereof. In practice and when the mustache and beard care tool 100 is fully assembled, the cylindrical hole 119A of the beard wax product 119 provides an opening and support for the threaded wax dispensing rod 121 when inserted into the cylindrical hole 119A of the beard wax product 119.

Figure 14:
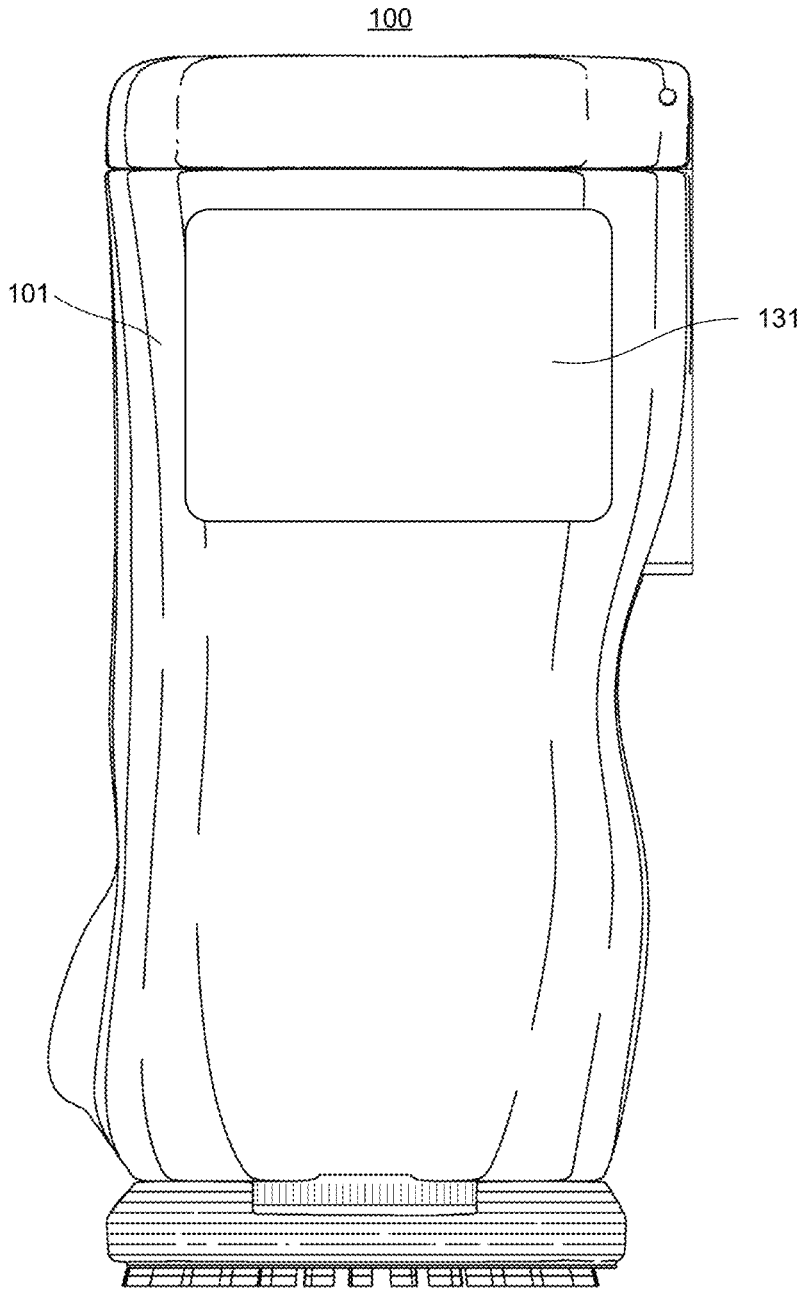
FIG. 14 illustrates a mirror applied to a front face of the housing of the mustache and beard care tool in accordance to an embodiment.

FIG. 14 illustrates a mirrored surface 131 applied to a front face of the housing 101 of the mustache and beard care tool 100 in accordance to an embodiment. The mirrored surface 131 may applied directly to the front face portion of the housing 101 using a reflective paint such as chrome or mirror paint or applied using an adhesive having a thin and flexible reflective surface with an adhesive backing such as, for example, chrome or mirror tape.

Figure 15:
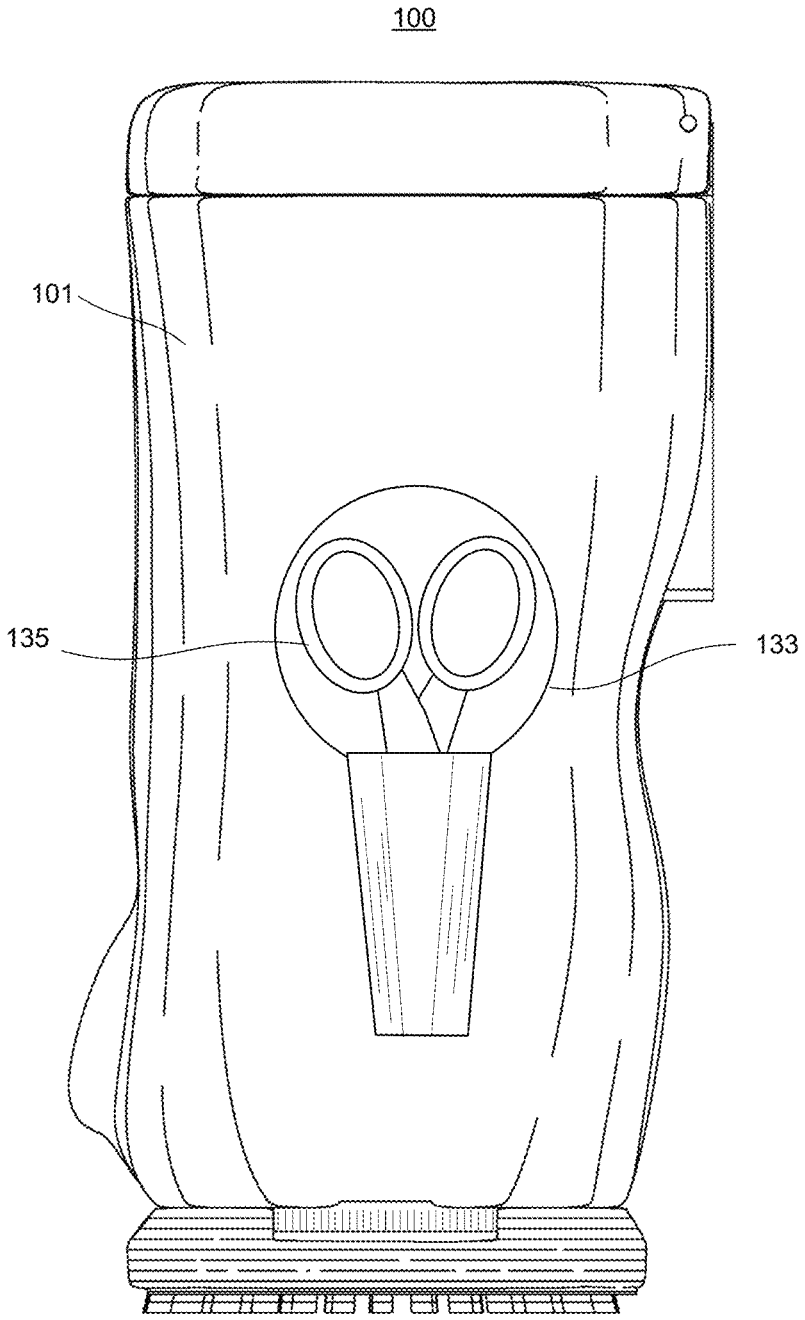
FIG. 15 illustrates configuration of the housing with an exterior accessory holder in accordance to an embodiment.

FIG. 15 illustrates configuration of the housing 101 with an exterior accessory holder in accordance to an embodiment. In this implantation, the housing 101 may include a scissors compartment 133 formed on an exterior surface of the housing 101 and configured to hold a pair of scissors 135.

Figure 16:
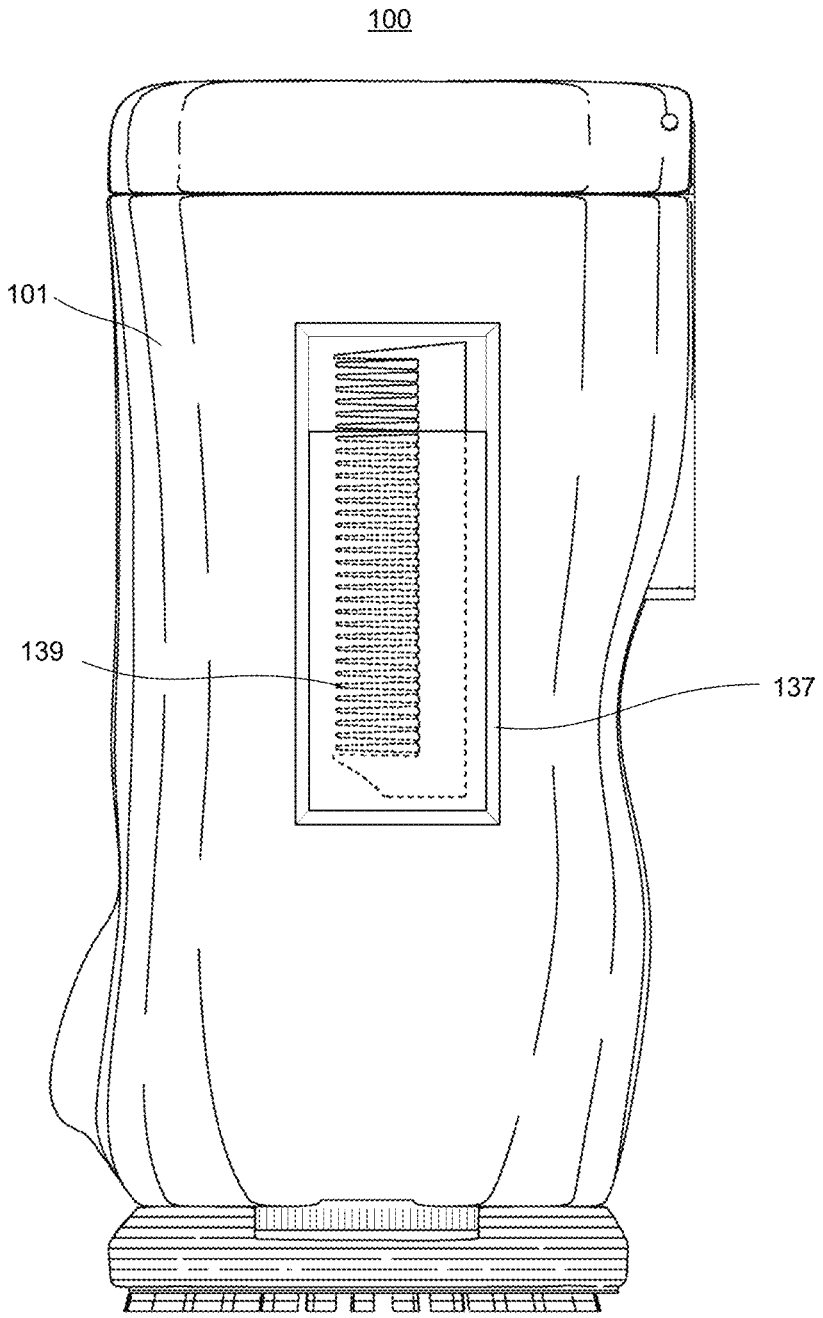
FIG. 16 illustrates another configuration of the housing with another exterior accessory holder in accordance to an embodiment.
Figure 17B:
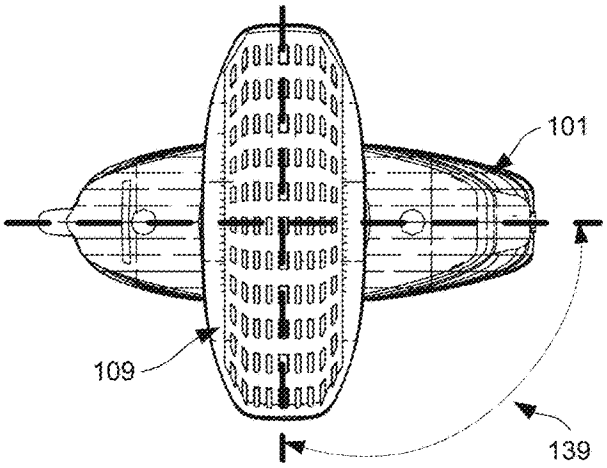
FIG. 17A-FIG. 17D illustrate a bottom view of the beard brush assembly at a normal position, a bottom view of the beard brush assembly at a rotated position, a side view beard brush assembly at the rotated position, and a perspective view of beard brush assembly at the rotated position, respectively, according to an embodiment.
Figure 17D:
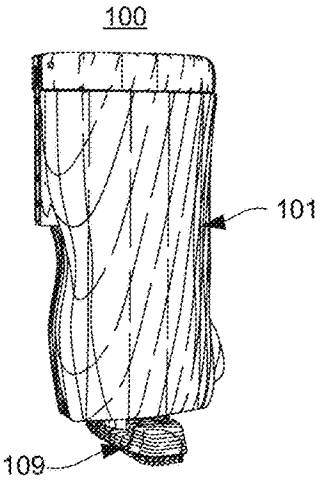
Figure 17A:
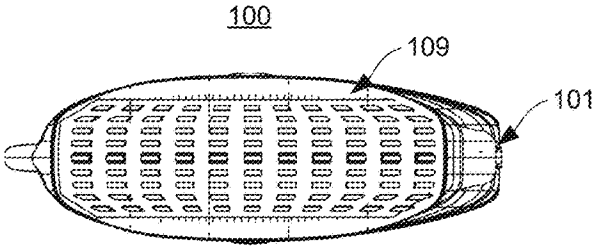
Figure 17C:
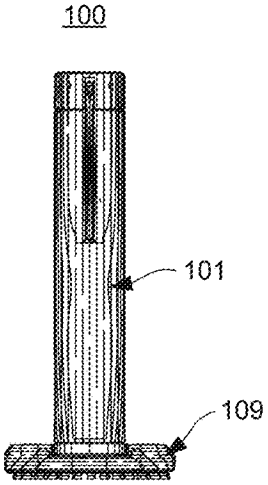

FIG. 16 illustrates another configuration of the housing 101 with another exterior accessory holder in accordance to an embodiment. In this implantation, the housing 101 may include a hair comb compartment 137 formed on an exterior surface of the housing 101 and configured to hold a hair comb 137.

FIG. 17A-FIG. 17D illustrate a bottom view of the beard brush assembly 109 at a normal position, a bottom view of the beard brush assembly 109 at a rotated position, a side view beard brush assembly 109 at the rotated position, and a perspective view of beard brush assembly 109 at the rotated position, respectively, according to an embodiment. In yet another embodiment, beard brush assembly 109 is connected to the wax dispensing controller 107 and configured to rotate, wherein the beard brush assembly 109 takes control of the control mechanism for dispensing and retracting the beard wax product 119 by rotating the beard brush assembly in either a clockwise or counterclockwise direction 139 as shown in FIG. 173. In practice, since the beard brush assembly 109 has a larger surface area than the wax dispensing controller 107, it may provide an easier means to grasp and rotate in order to dispense and retract the beard wax product 119 as compared to the smaller surface area provided by the wax dispensing controller 107.

Figure 18A:
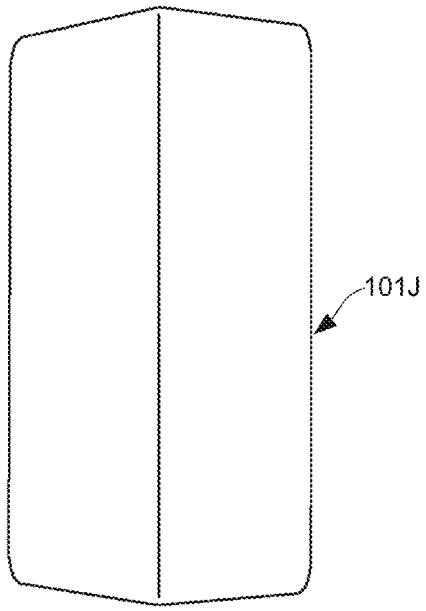
FIG. 18A-FIG. 18C illustrate different housing shapes and configurations according to an embodiment.
Figure 18B:
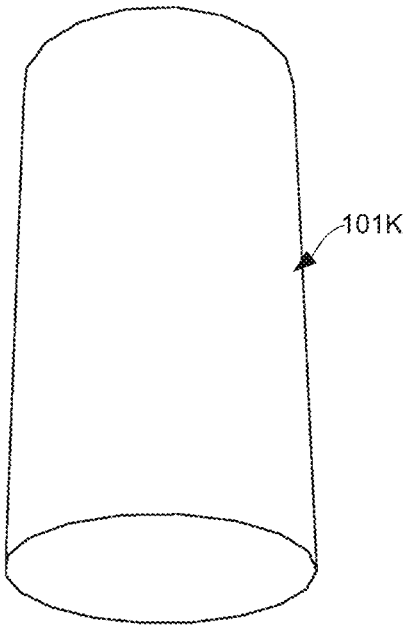
Figure 18C:
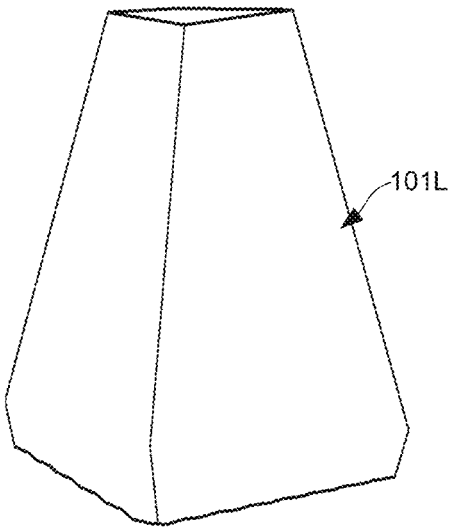

FIG. 18A-FIG. 18C illustrate different housing 101 shapes and configurations according to an embodiment. For example, the housing 101 may assume various shapes such as a rectangular box 101J, a cylinder or tube 101K, or a polyhedron 101L as shown in FIG. 18A-FIG. 1C, respectively.

Figure 19A:
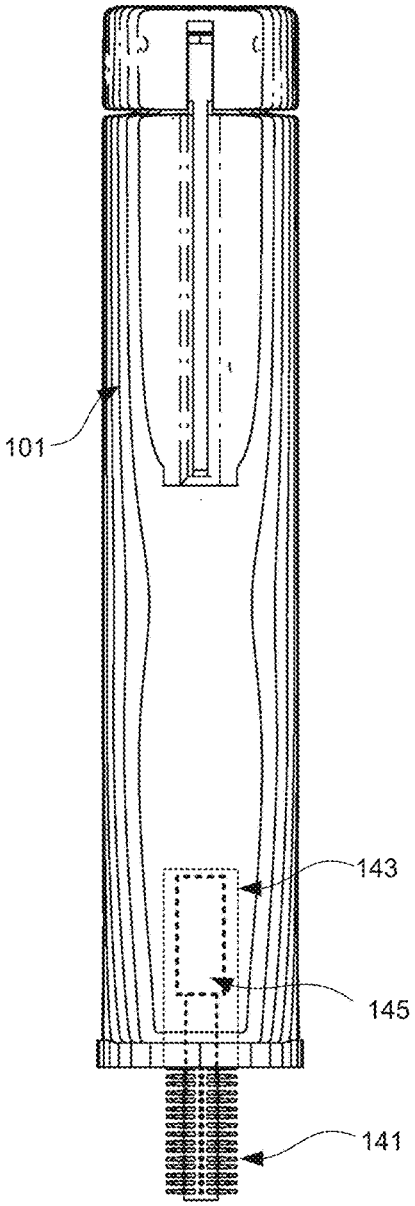
FIG. 19A-FIG. 19C illustrate a built-in round brush according to an embodiment.
Figure 19B:
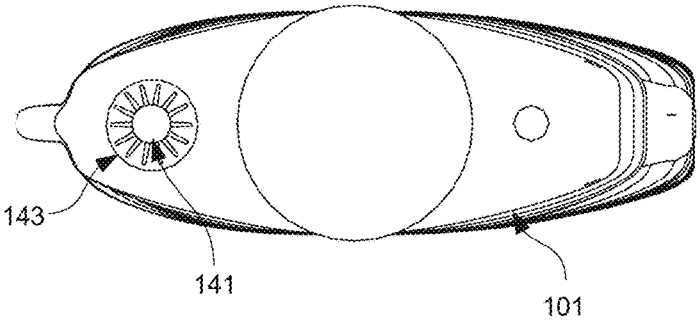
Figure 19C:
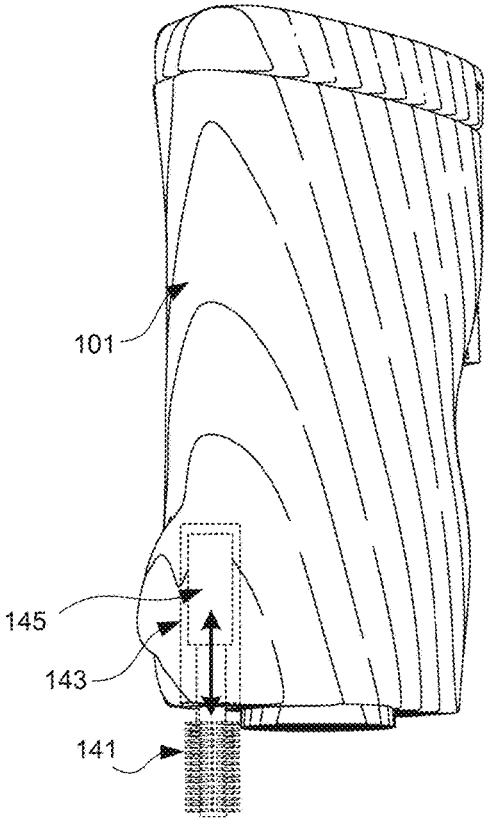

FIG. 19A-FIG. 19C illustrate a built-in round brush 141 according to an embodiment. In yet another implementation, the housing 101 may include a round brush hole 143 formed at the bottom of the housing 101 and a push-pull spring plunger 145 coupled to a round wall formed by the round brush hole 143 at a first end and coupled to the built-in round brush 141 an end opposite to the first end. In practice, the user may push the built-in round brush 141 towards the direction of the housing 101 to disengage the spring locking mechanism, allowing the brush to extend outward from the round brush hole 143. To hide the built-in round brush 141, the user may push it again towards the direction of the housing 101 to reengage the spring locking mechanism, allowing the brush to be locked in place and hidden inside the round brush hole 143.

Figure 20A:
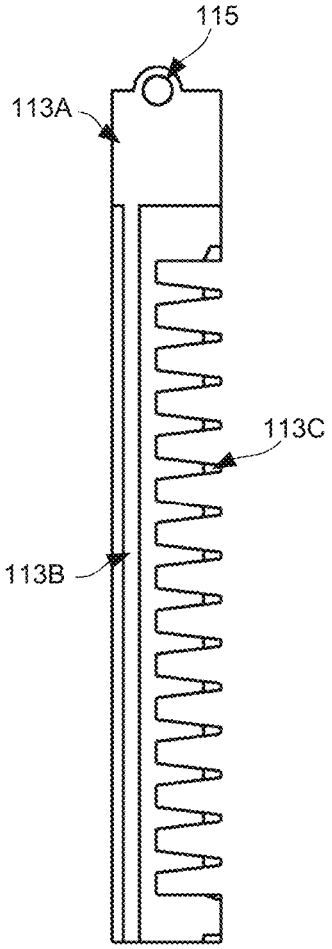
FIG. 20A-FIG. 20C illustrate various comb sizes according to an embodiment.
Figure 20B:
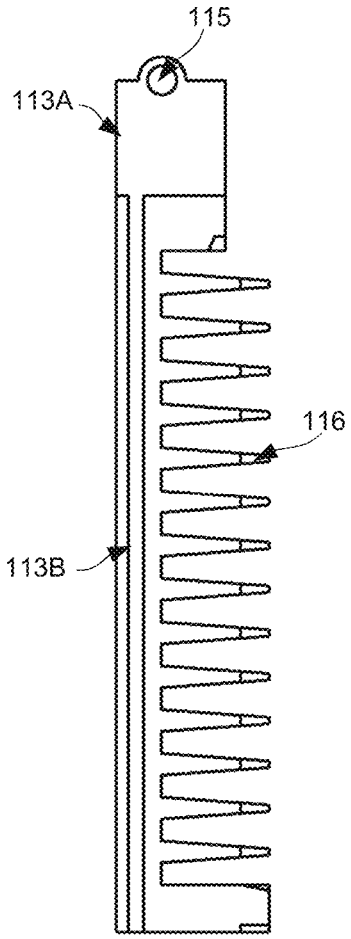
Figure 20C:
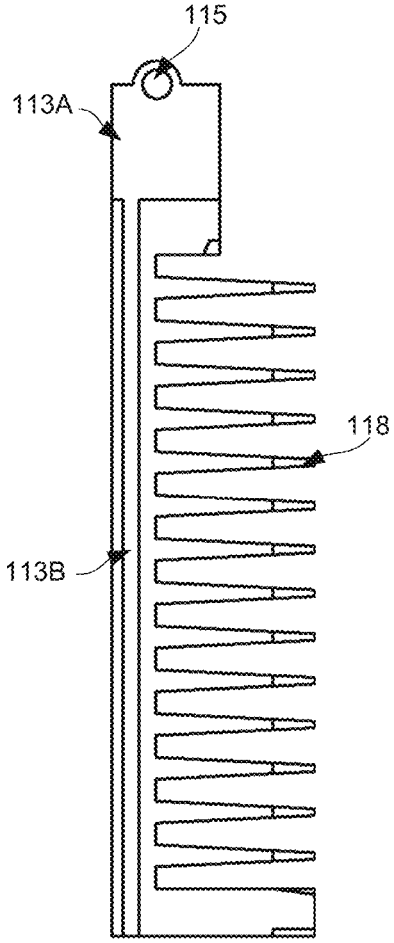

FIG. 20A-FIG. 20C illustrate various comb sizes according to an embodiment. In still yet another implementation, the mustache and beard care tool 100 may include various size combs such as the semi-movable comb 113 having the narrow size set of teeth 113C, the comb 113 having a medium size set of teeth 116, and the comb having a large size set of teeth 118 as shown in FIG. 20A, FIG. 20B, and FIG. 20C, respectively. In practice, the different comb sizes provide the user with various tools to style different lengths of hair on the mustache or beard. Also, as previously discussed the ability to attach and remove the semi-movable comb 113 to and from the lid 103 provides the user the benefit of swapping combs with a replacement comb should it get damaged or swapping it with another type of comb having a different size, style, or comb teeth for different grooming purposes.

Figure 21:
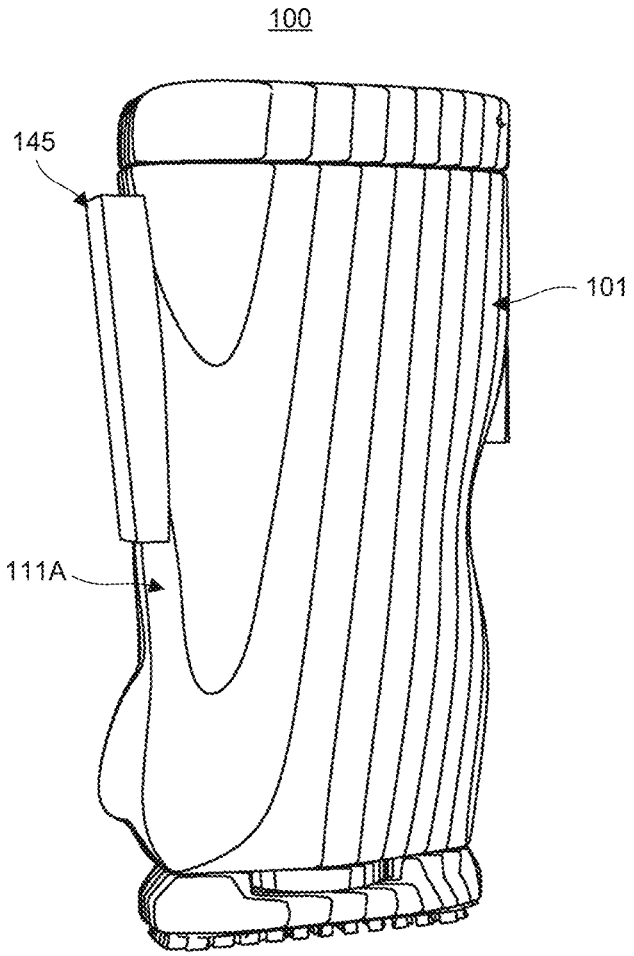
FIG. 21 illustrates another configuration of the housing having another exterior accessory holder in accordance to an embodiment.

FIG. 21 illustrates another configuration of the housing 101 having another exterior accessory holder in accordance to an embodiment. In this implantation, the housing 101 may include a replacement comb storage compartment 137 formed on the exterior edge or side 111A of the housing 101 for storing one or more replacement combs.

Figure 22A:
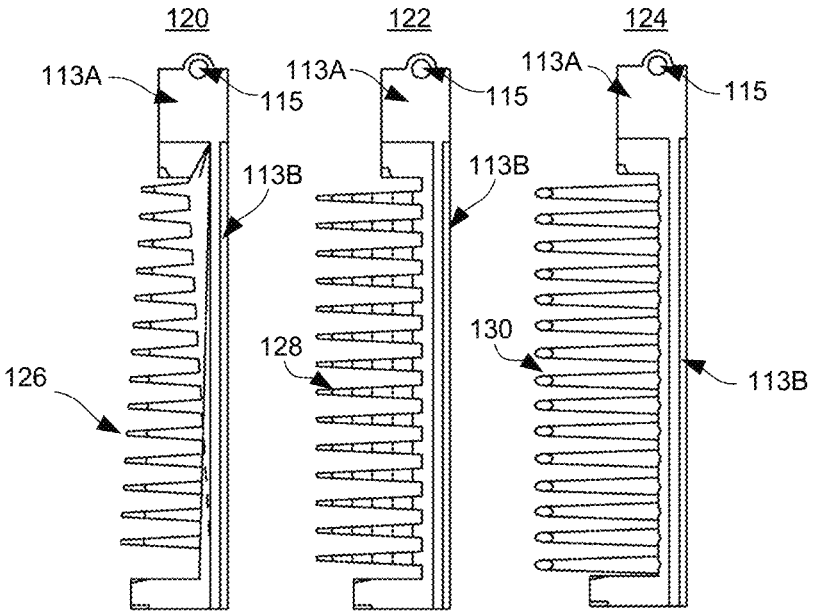
FIG. 22A-FIG. 22C illustrate multiple comb-teeth variations as shown in a front, a top, and a perspective view, respectively, according to an embodiment.
Figure 22B:
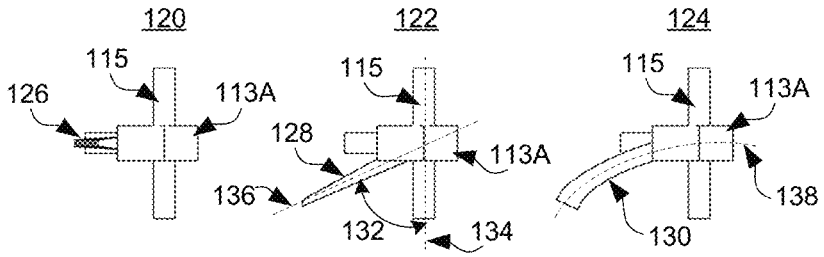
Figure 22C:
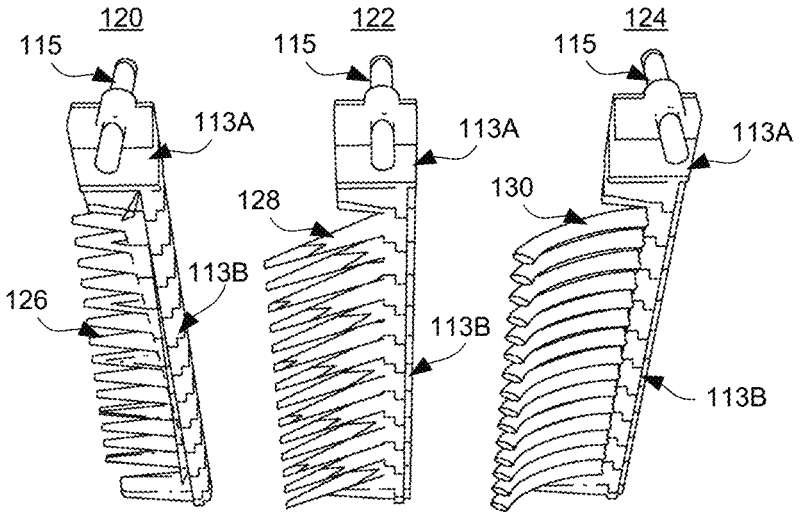

FIG. 22A-FIG. 22C illustrate multiple comb-teeth variations as shown in a front, a top, and a perspective view, respectively, according to an embodiment. In yet another implementation, the mustache and beard care tool 100 may include various size teeth structures including, for example, a comb 120 having teeth of different sizes 126 (as shown in FIG. 22A), a comb 122 having a rotated set of teeth 128 (as shown in FIG. 22B and FIG. 22C), and a comb 124 having a curved set of teeth 130 (as shown in FIG. 22B and FIG. 22C). As shown in FIG. 22A, a set of different teeth sizes 126 where each tooth of the comb 120 may be structured to gradually increase in size from one end of the comb 120 to the opposing end thereof. In another implementation, as shown in FIG. 22B, the comb 122 having the rotated set of teeth 122 is rotated at an acute angle 132 formed between a vertical centerline 134 of the pin 115 and a second centerline 136 defined as a lengthwise portion of the rotated set of teeth 122. In addition, the rotated set of teeth 122 is rotated about a pivot point (not shown) which is, in this example, the center point of the pin 115. In yet another implementation, as shown in FIG. 22B and FIG. 22C, the comb 124 having the curved set of teeth 130 includes individual teeth that are each curved and follow an arc path 138.

Figure 23A:
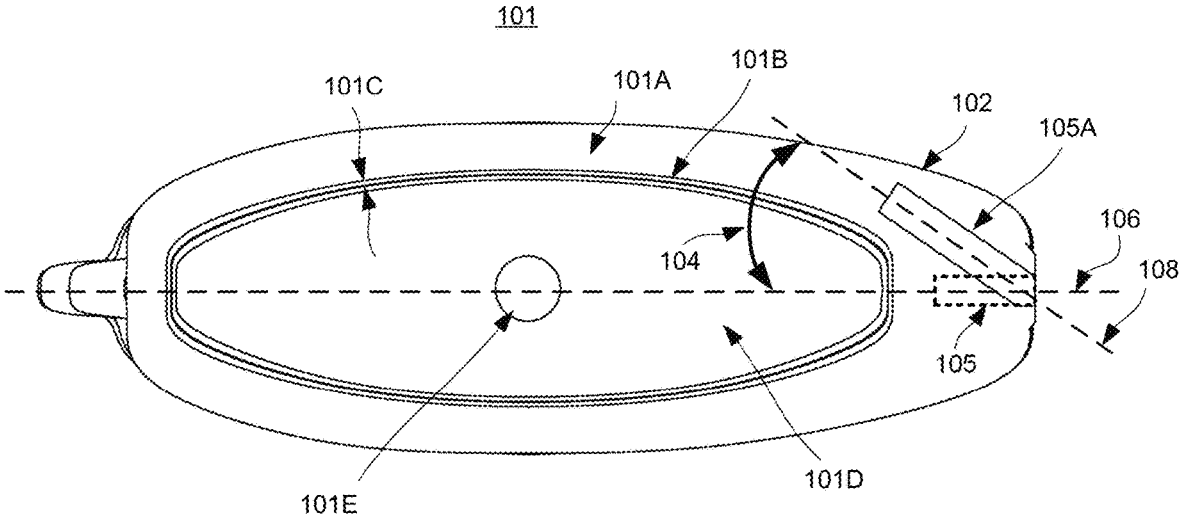
FIG. 23A and FIG. 23B illustrate variations of the comb holder slot which is formed in the wall enclosure of the housing, including a rotated comb holder slot and a curved comb holder slot, respectively, in accordance to an embodiment.
Figure 23B:
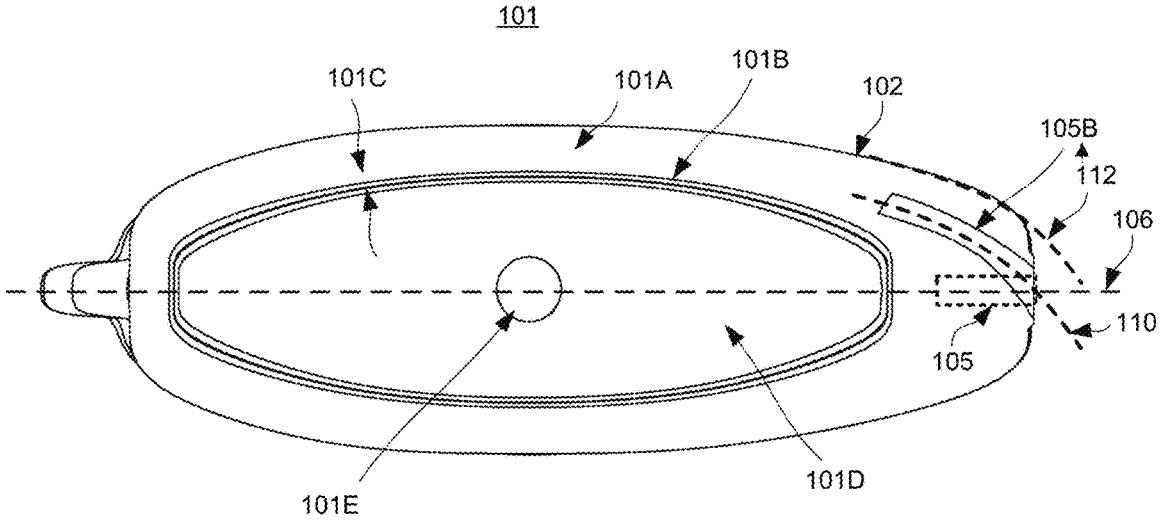

FIG. 23A and FIG. 23B illustrate variations of the comb holder slot 105 which is formed in the wall enclosure 101A of the housing 101, including a rotated comb holder slot 105A and a curved comb holder slot 105B, respectively, in accordance to an embodiment. In one implementation, the rotated comb holder slot 105A is formed between the protruding support lip 101B and a wall exterior 102 and rotated at an acute angle 104 defined between a centerline 106 of the housing 101 and a centerline 108 of the rotated comb holder slot 105A. By rotating the comb holder slot 105A so that it is positioned in the wall enclosure 101A instead of in the direction of the protruding support lip 101B having limited space, this rotation allows for the comb holder slot 105A to have a larger width than the comb holder slot 105 previously presented. In one aspect and advantage, the rotated comb holder slot 105A having the larger width may receive and support combs having longer teeth as the comb presented in FIG. 20C. In yet another implementation as shown in FIG. 23B, the curved comb holder slot 105B may be formed between the protruding support lip 101B and the wall exterior 102 which is similar to the previous example. However, in this example, the curved comb holder slot 105B may include a curved channel following a curve path 110 that generally follows a curved wall edge 112 of the wall enclosure 101A. Moreover, the comb holder slot 105B may be positioned directly in the wall enclosure 101A instead of in the direction of the protruding support lip 101B having limited space, allowing for the comb holder slot 105B to also have a larger width than the comb holder slot 105. In one aspect and advantage, the curved comb holder slot 105B having the larger width may receive and support combs having longer curved teeth like the curved comb 124 presented in FIG. 22B.

Figure 24A:
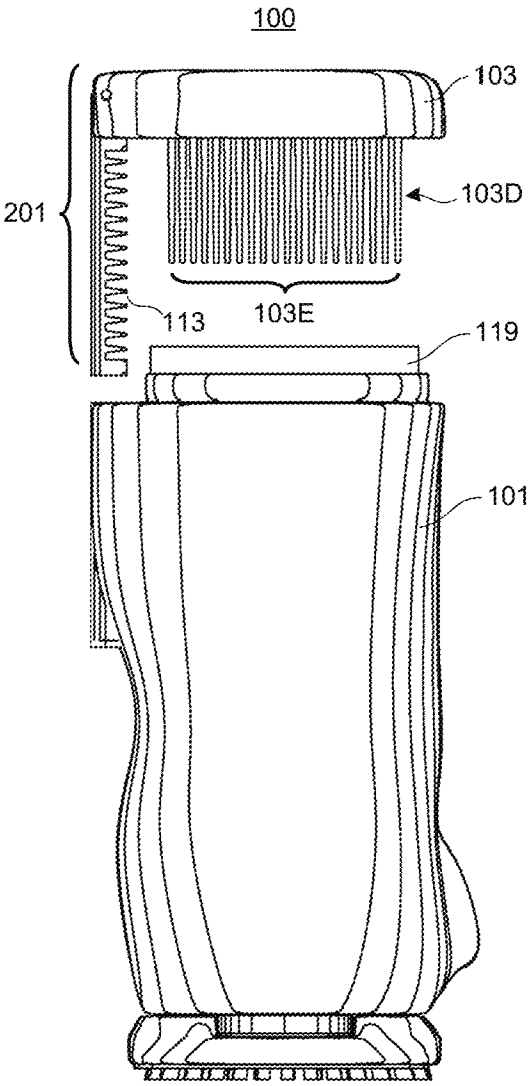
FIG. 24A-FIG. 24D illustrate a dual lid-comb assembly of the mustache and beard care tool in accordance to an embodiment.
Figure 24B:
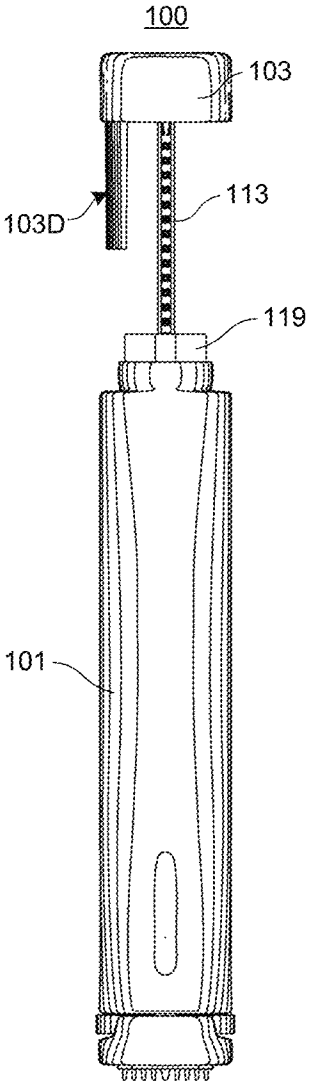
Figure 24C:
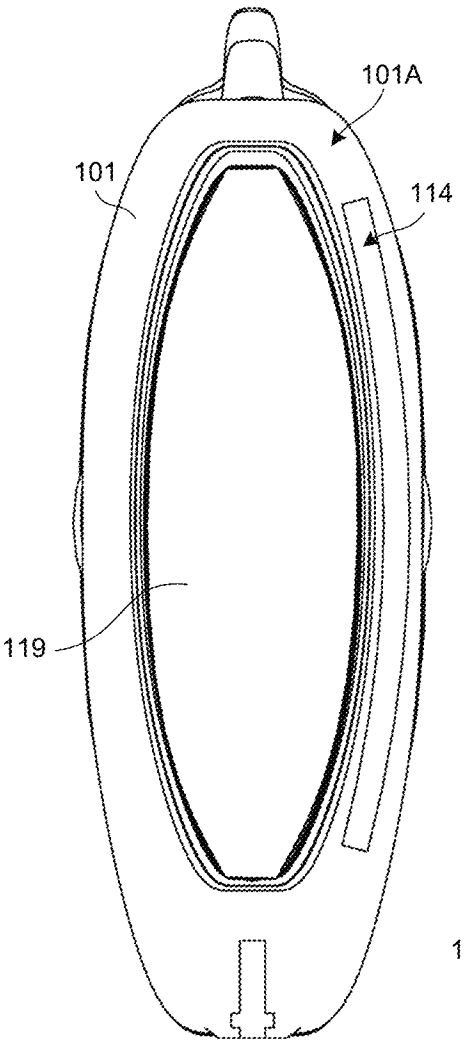
Figure 24D:
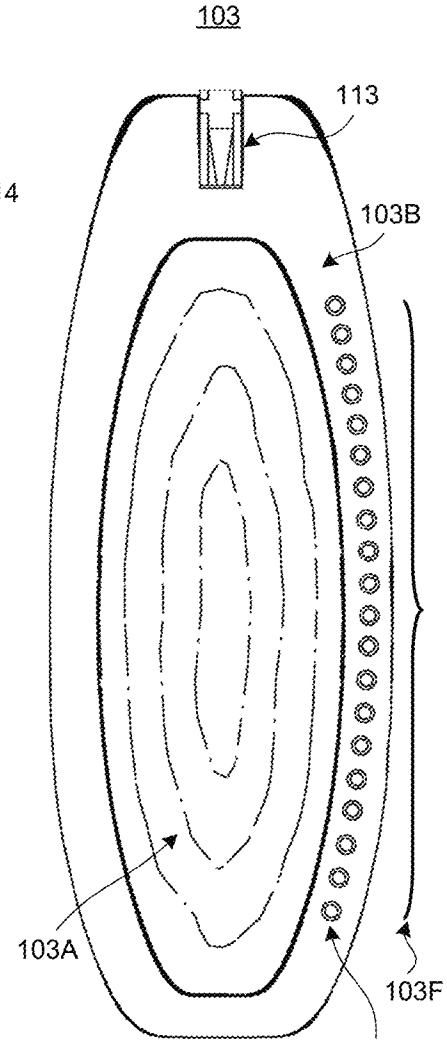

FIG. 24A-FIG. 24D illustrate a dual lid-comb assembly 201 of the mustache and beard care tool 100 in accordance to an embodiment. In yet another implementation, the lid 103 may include a fixed comb 103D having a plurality of lid teeth 103E formed on a portion of the interior lid wall enclosure 103B as shown in a front view of tool 100 in FIG. 24A, a side view of tool 100 in FIG. 24B, and a bottom view of the lid 103 in FIG. 24D. When the tool 100 is fully assembled (i.e., lid 103 is attached to the housing 101), the plurality of lid teeth 103E may be extended in length and configured to be inserted into a lid-comb slot 114 that is formed in a portion of the wall enclosure 101A of the housing 101 as shown in a top view of the housing 101 in FIG. 24C. In practice, the fixed comb 103D with extended teeth provides the user the benefit of having another type of comb that is capable of grooming thick, coarse or long-haired beards. Referring to FIG. 24D, each teeth of the plurality of lid teeth 103E is distributed along a curved section 103F of the interior lid wall enclosure 103B.

Figure 25:
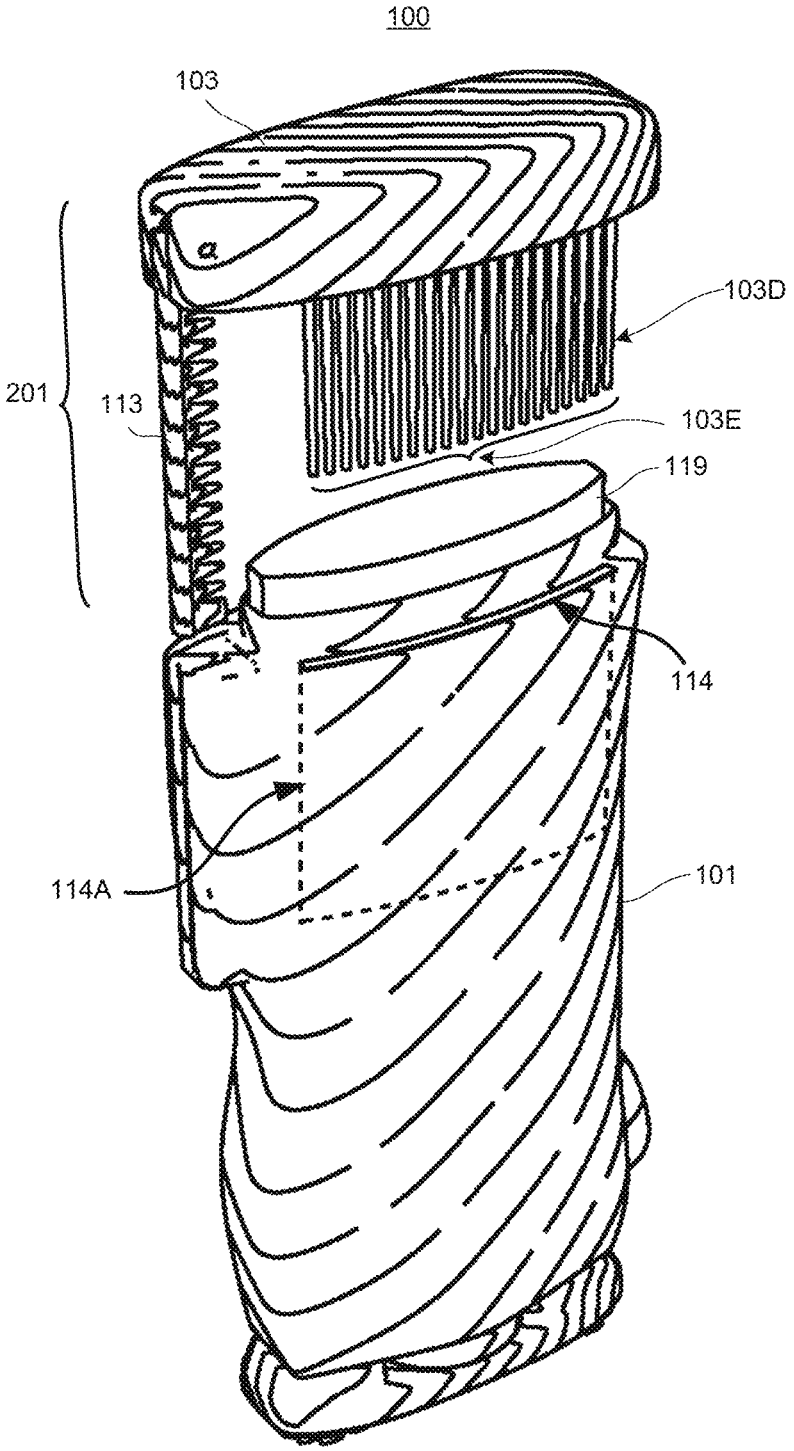
FIG. 25 illustrates a perspective view of the dual lid-comb assembly of the mustache and beard care tool in accordance to an embodiment.

FIG. 25 illustrates a perspective view of the dual lid-comb assembly 201 of the mustache and beard care tool in accordance to an embodiment. In this implementation, the lid-comb slot 114 lid-comb slot 114 is configured to extend further into a single inner channel portion 114A formed in the wall enclosure 101A into which the plurality of lid teeth 103E of the fixed comb 103D may be inserted and fully encased thereby protecting the fixed comb 103D.

Figure 26D:
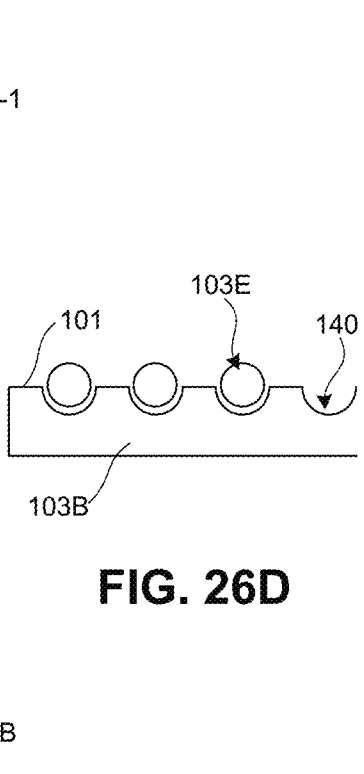
FIG. 26A-FIG. 26D illustrate the dual lid-comb assembly of the mustache and beard care tool implementing multiple comb channels formed on a surface of the housing, in accordance to an embodiment.
Figure 26C:
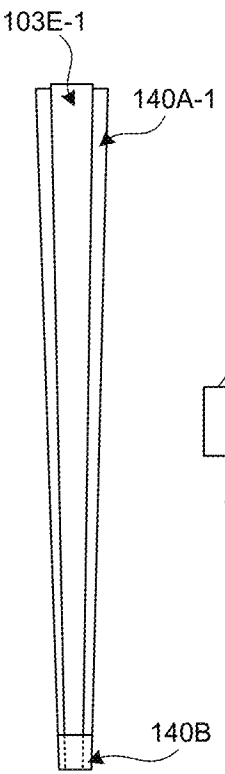
Figure 26B:
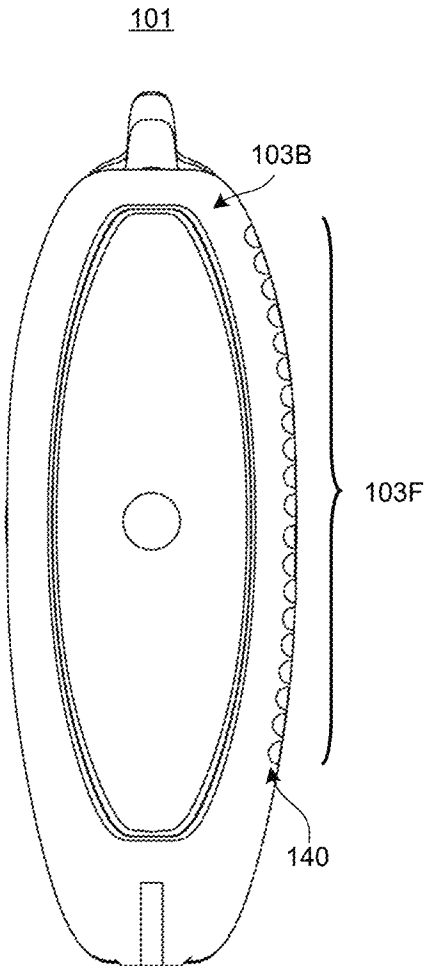
Figure 26A:
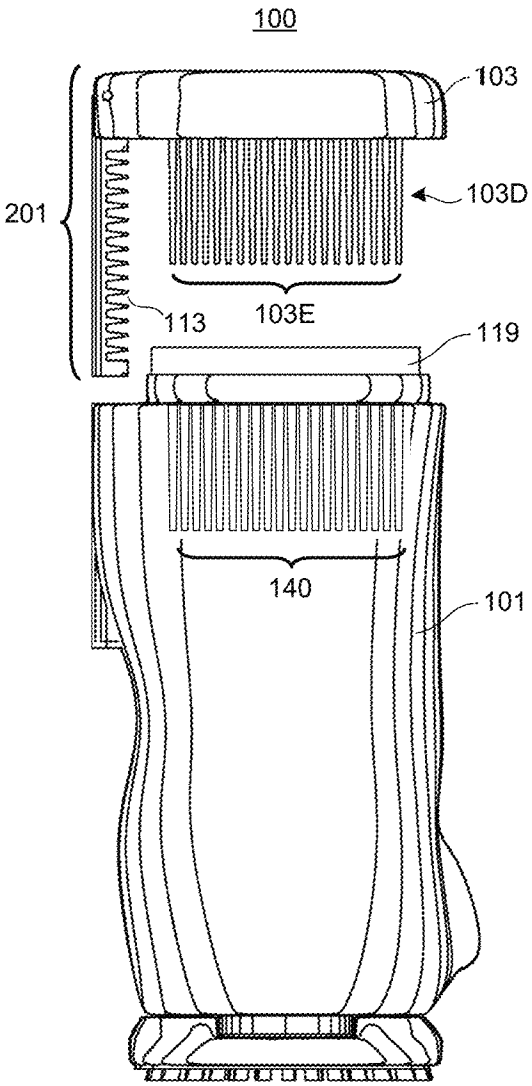

FIG. 26A-FIG. 26D illustrate the dual lid-comb assembly 201 of the mustache and beard care tool 100 implementing multiple comb channels formed on a surface of the housing 101, in accordance to an embodiment. Instead of the lid-comb slot 114 that was described hereinabove, a plurality of comb channels 140 formed on a surface of the housing 101 may be used to hold the plurality of lid teeth 103E in place, leaving the plurality of lid teeth 103E partially exposed to the surface of the housing 101 and unobstructed when seated or occupied in the plurality of comb channels 140, in another implementation. As shown in a FIG. 26A which depicts a front view of the mustache and beard care tool 100, the total number of individual comb channels is configured to match and be equal to the total number of individual teeth that defines the plurality of lid teeth 103E. In this example, the total number of individual comb channels, which is equal to the number of individual teeth that define the plurality of lid teeth 103E, is 20. In practice, each individual tooth is generally configured to occupy a corresponding individual comb channel. Referring a top view of the housing 101 as shown in FIG. 26B, each individual tooth of the plurality of lid teeth 103E is generally placed and distributed along the very edge of the curved section 103F of the interior lid wall enclosure 103B. FIG. 26C illustrates a side view of an individual tooth 103E-1 of the plurality of lid teeth 103E and a corresponding individual comb channel 140-1 that is inserted into the individual tooth 103E-1. In addition, the each individual comb channel may include a guardrail 140B to prevent the each individual comb channel from slipping out of the channel. FIG. 26D illustrates a top isolated view and cross-section of one section of the plurality of lid teeth 103E inserted into a section of the plurality of comb channels 140. In this example, each individual tooth of the lid teeth 103E structure is cylindrical in shape and each corresponding individual comb channel of the plurality of comb channels 140 is complementary in shape (i.e., hemispherical). In other implementations, each individual tooth may include other structures including, for example, cones, square tubes, threaded rods, and the like. Furthermore, each individual comb channel may also include other structures including, for example, cones, square tubes, threaded rods, and the like. In practice, the shape of each individual tooth is configured to be complementary to the shape of the individual comb channel in order to provide a hand in glove type fit.

Figure 27:
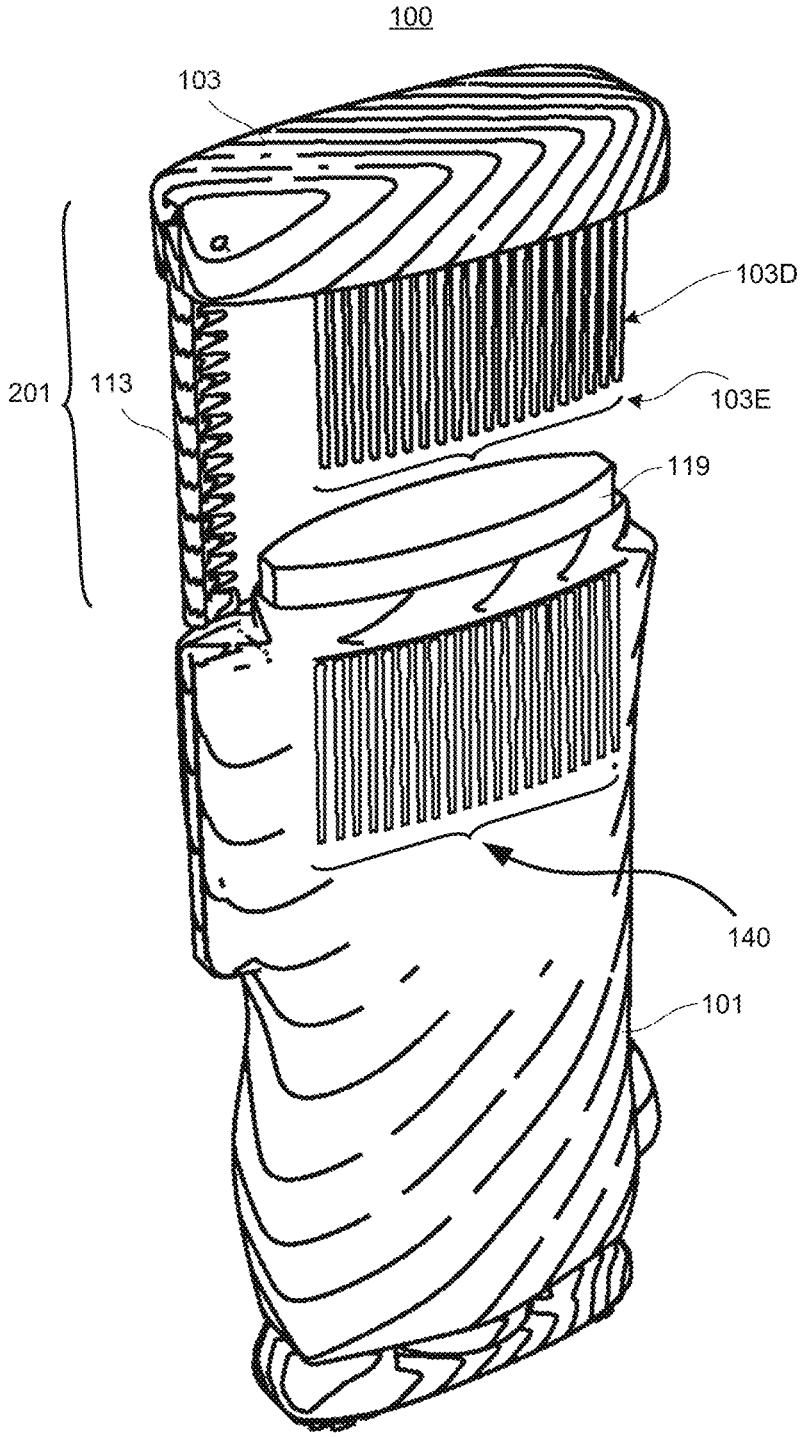
FIG. 27 illustrates the perspective view of the dual lid-comb assembly of the mustache and beard care tool implementing a plurality of comb channels formed on a surface of the housing, in accordance to an embodiment.

FIG. 27 illustrates the perspective view of the dual lid-comb assembly 201 of the mustache and beard care tool 100 implementing a plurality of comb channels 140 formed on a surface of the housing 101, in accordance to an embodiment. In this illustration, each comb channel of the plurality of comb channels 140 is configured to match the size and shape (i.e., complementary) of each comb teeth of the plurality of lid teeth 103E of the fixed comb 103D and configured to receive and secure the plurality of lid teeth 103E when the plurality of lid teeth 103E is inserted into the plurality of comb channels 140. In this example, the dual lid-comb assembly 201 having a plurality of comb channels 140 formed on a surface of the housing 101 provides the user the benefit of easily accessing, attaching, and detaching the lid 103 from the housing 101 since the plurality of lid teeth 103E is unobstructed and freely sits in the comb channels 140 of the housing 101 rather than being enclosed in the housing 101 as in the previous embodiment.

Figure 28:
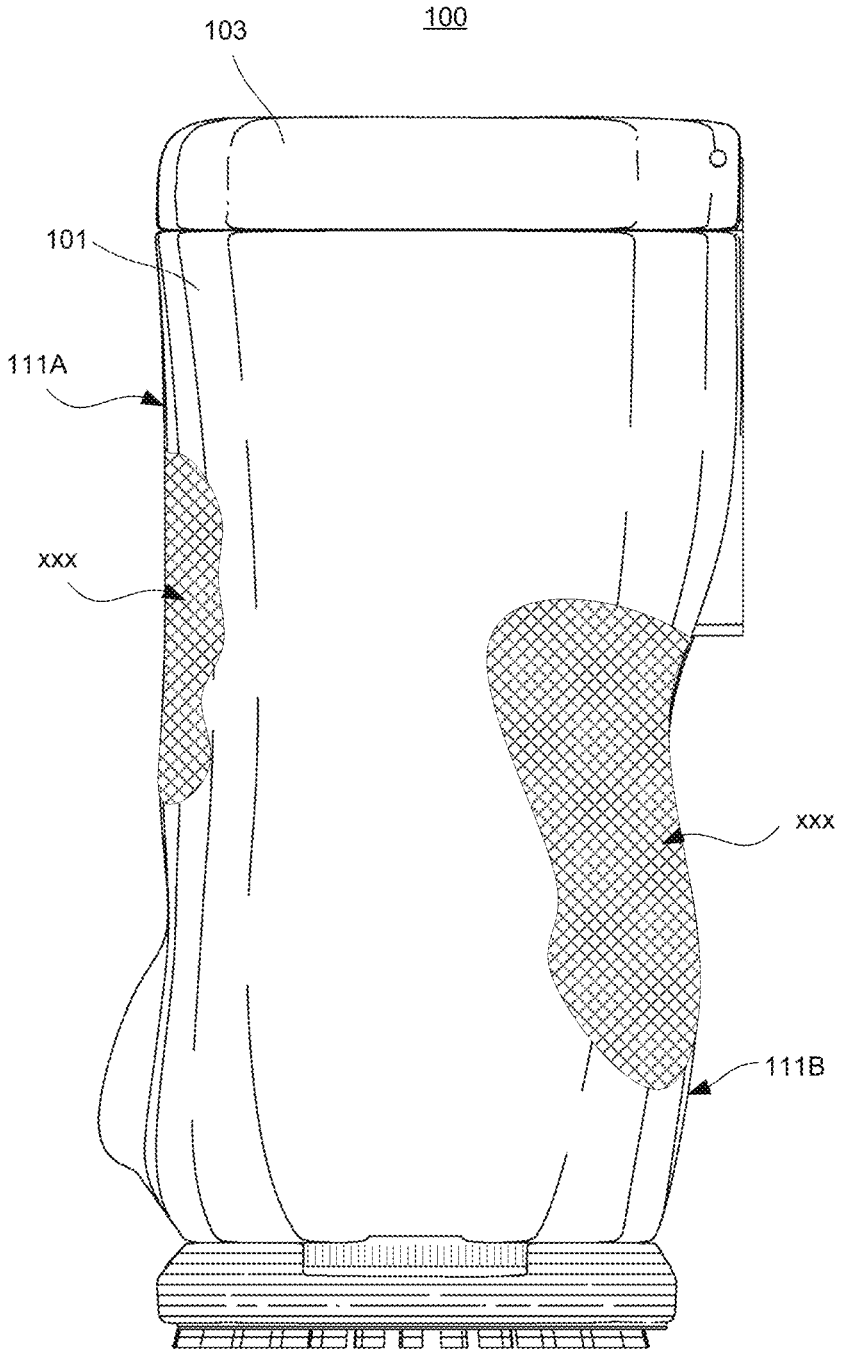
FIG. 28 illustrates a non-slip grip tape applied to the housing of the mustache and beard care tool in accordance to an embodiment.

FIG. 28 illustrates a non-slip grip tape 147 applied to the housing 101 of the mustache and beard care tool 100 in accordance to an embodiment. In this embodiment, the housing 101 may include a non-slip grip tape 147 attached using an adhesive to the sides (111A, 111B) of the housing 101, providing an improved grip to the surface of the housing 101 when held by the user.

Figure 29:
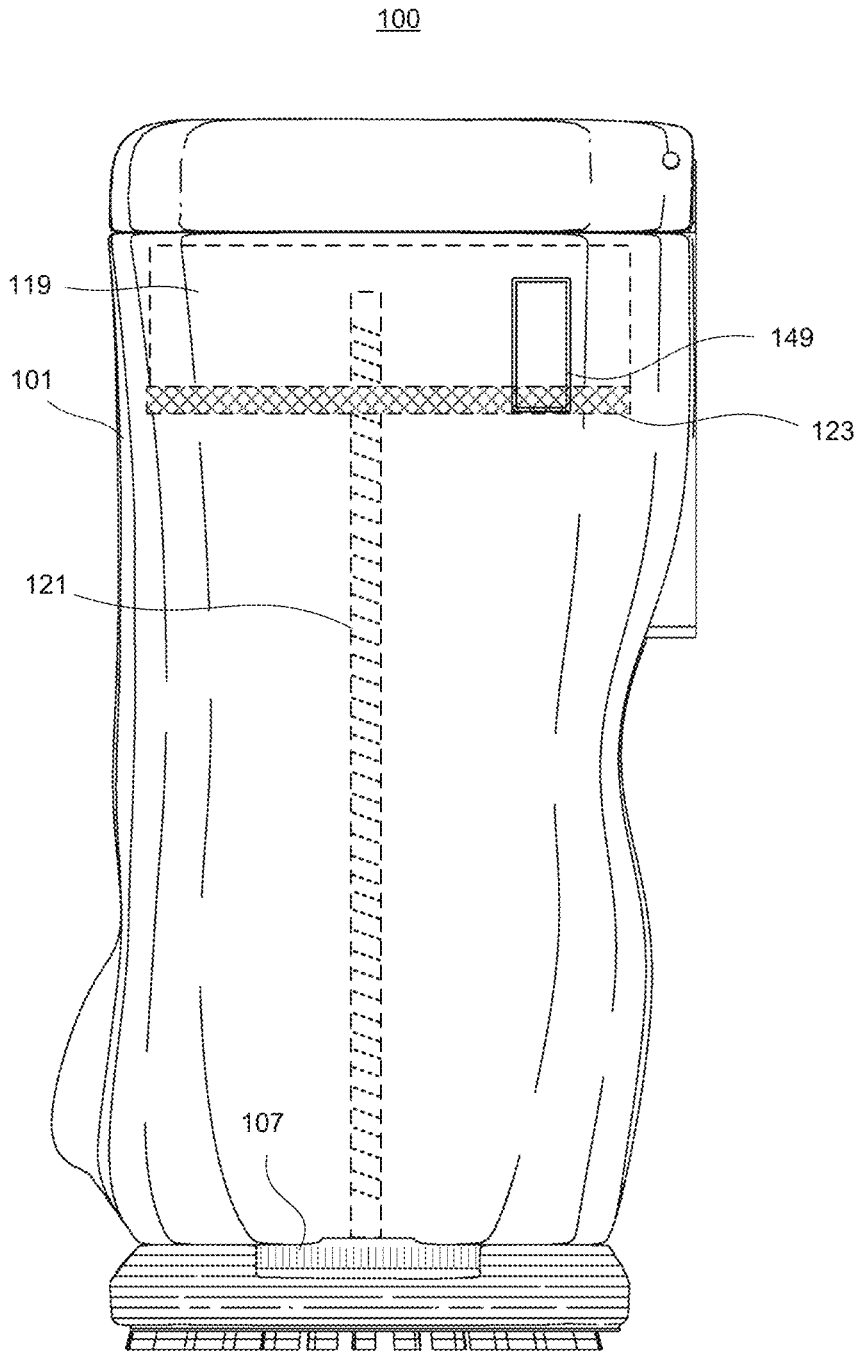
FIG. 29 illustrates a beard wax level indicator window formed on the housing of the mustache and beard care tool in accordance to an embodiment.

FIG. 29 illustrates a beard wax level indicator window 149 formed on the housing 101 of the mustache and beard care tool 100 in accordance to an embodiment. The beard wax level indicator window 149 may be a rectangular opening in the housing 101 located near the top portion of the housing 101 and optionally covered by a clear plastic or acrylic window. In one application, the beard wax level indicator window 149 may serve as an empty indicator, providing a visual feedback of when the beard wax product 119 of the mustache and beard care tool 100 is near empty or completely empty. For example, this may be accomplished by applying or making the wax dispensing support platform 123 red in color (or any other bright colors generally coded as an alert color) through paint, dyes, films, or material substances. Once the beard wax product 119 reaches the top portion of the housing 101 using the wax dispensing controller 107, the red color of the wax dispensing support platform 123 is made to be visible in the beard wax level indicator window 149, providing the visual indication that the beard wax product 119 is near empty.

Figure 30:
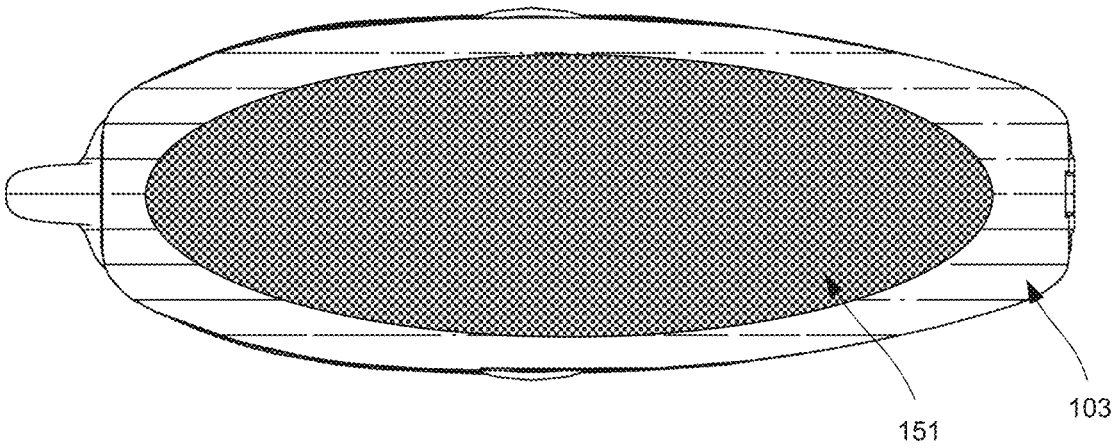
FIG. 30 illustrates a top lid accessory formed on the lid of the mustache and beard care tool in accordance to an embodiment.

FIG. 30 illustrates a top lid accessory 151 formed on the lid 103 of the mustache and beard care tool 100 in accordance to an embodiment. In this example, the lid 103 may include a top lid accessory 151 applied to the surface of the lid 103 using an adhesive. The top lid accessory 151 may include, for example, a fine grit sandpaper, a facial wipe, a sponge, or a pad for providing additional tools for mustache and beard care and grooming.

Figure 31:
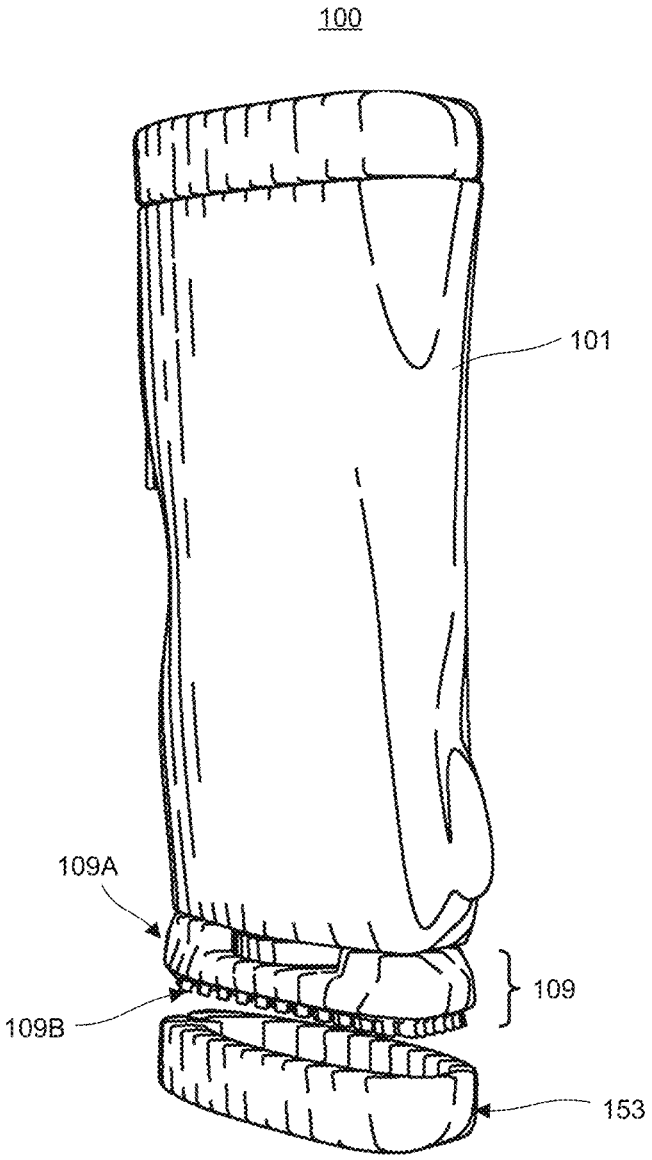
FIG. 31 illustrates a brush cover for the beard brush assembly in accordance to an embodiment.

FIG. 31 illustrates a brush cover 153 for the beard brush assembly 109 in accordance to an embodiment. In this embodiment, the mustache and beard care tool 100 may include the brush cover 153 coupled to the brush handle 109A of the beard brush assembly 109 for protecting and covering the plurality of short teeth 109B.

Figure 32:
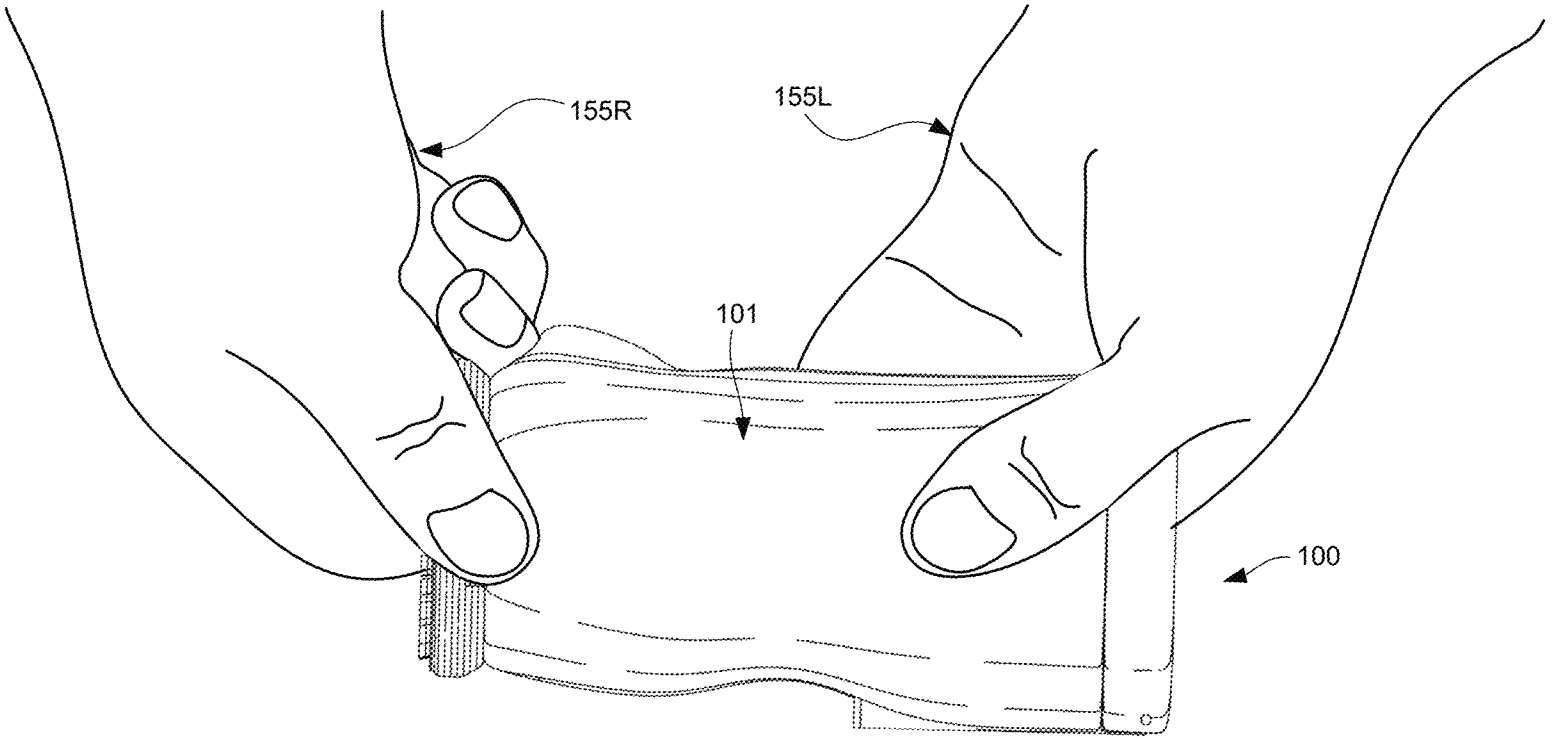
FIG. 32 illustrates a general method of handling the mustache and beard care tool with both hands of the user in accordance to an embodiment.

FIG. 32 illustrates a general method of handling the mustache and beard care tool 100 with both hands (155L, 155R) of the user in accordance to an embodiment. In this example, the top portion of the housing 101 may be gripped by the left hand 155L of the user while the bottom portion of the housing 101 is gripped by the right hand of the user with the right thumb applied over the wax dispensing controller 107 (not shown). In practice, the right thumb may be used to rotate (clockwise or counterclockwise) the wax dispensing controller 107 for dispensing or retracting the beard wax product 119 from or to the housing 101.

Figure 33:
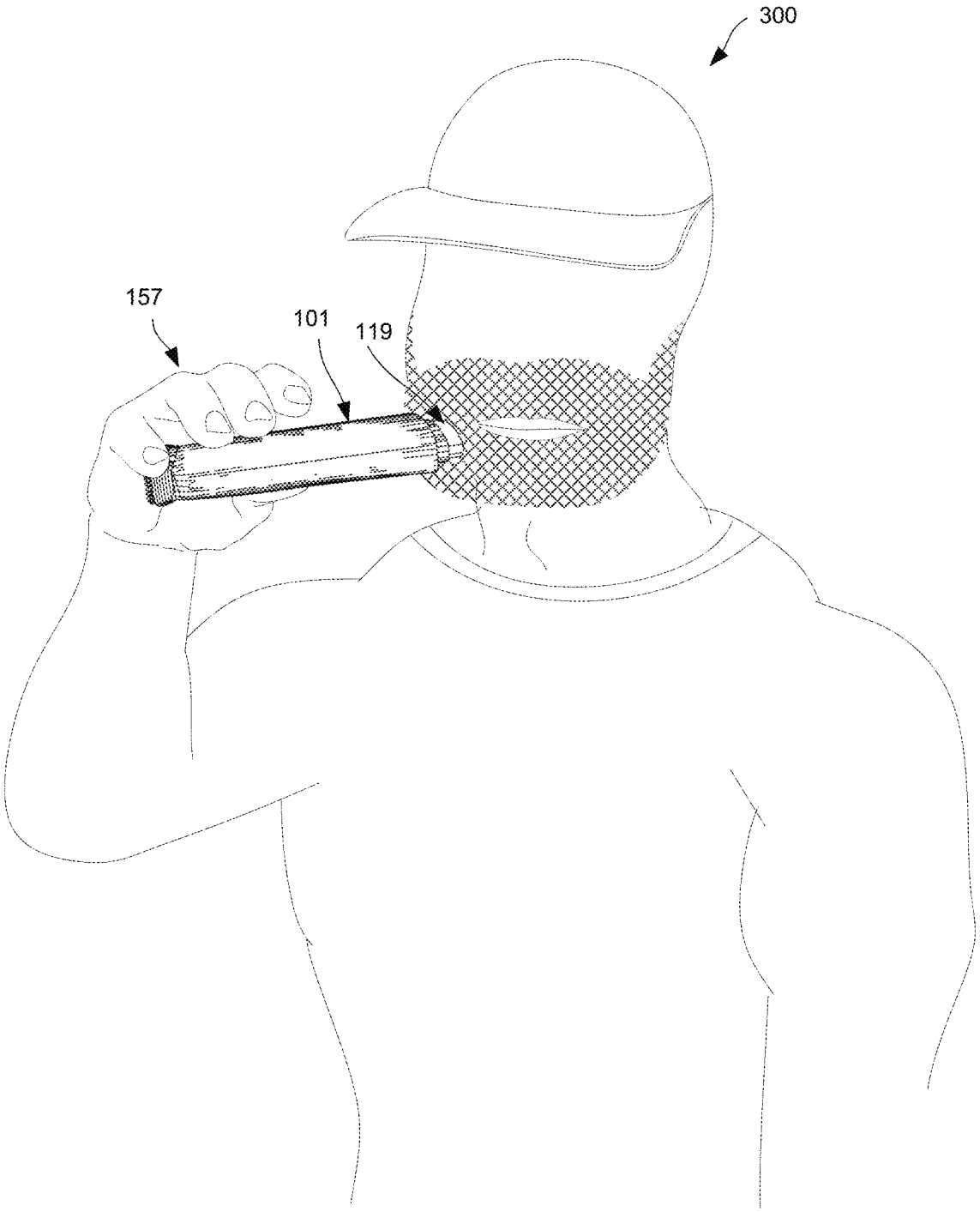
FIG. 33 illustrates a typical method of applying the beard wax product of the mustache and beard care tool to the mustache or beard of a bearded user in accordance to an embodiment.

FIG. 33 illustrates a typical method of applying the beard wax product 119 of the mustache and beard care tool 100 to the mustache or beard of a bearded user 300 in accordance to an embodiment. In this example, the bottom of the housing 101 may be held by one hand 157 of the user 300 while pointing the top portion of housing 101 with the beard wax product 119 exposed towards the user's beard or mustache. The user may then gradually apply an even coat of the beard wax product 119 over beard or mustache using gentle and even strokes.

Figure 34:
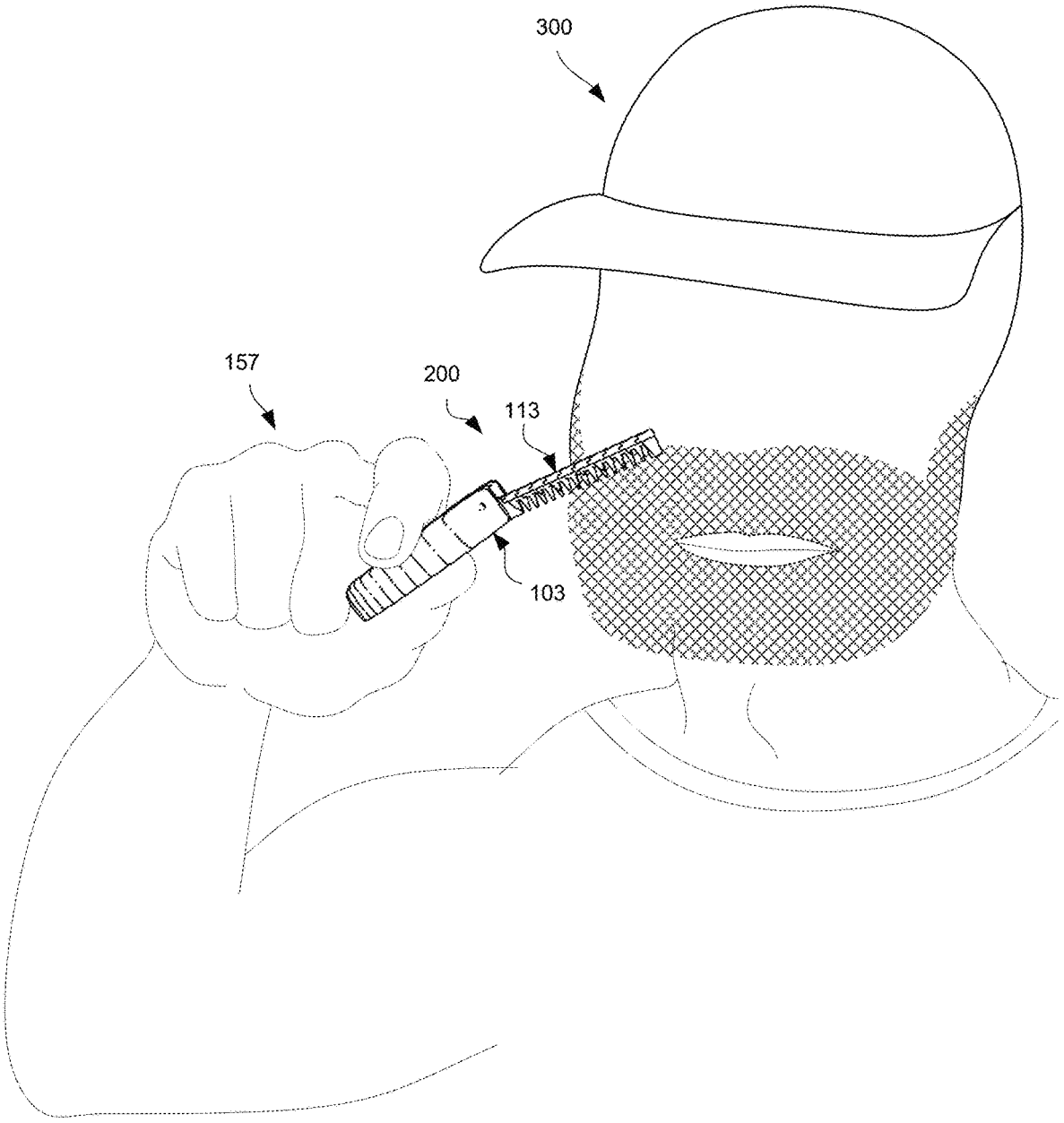
FIG. 34 illustrates a method of using the lid-comb assembly groom the mustache or beard of the bearded user in accordance to an embodiment.

FIG. 34 illustrates a method of using the lid-comb assembly 200 groom the mustache or beard of the bearded user 300 in accordance to an embodiment. In this example, the semi-movable comb 113 is rotated 90 degrees to a fully extended and open position as shown. The lid 103 of the lid-comb assembly 200 may be held by one hand 157 of the user 300 while using the semi-movable comb 113 to style or groom the user's beard or mustache as shown.

Figure 35:
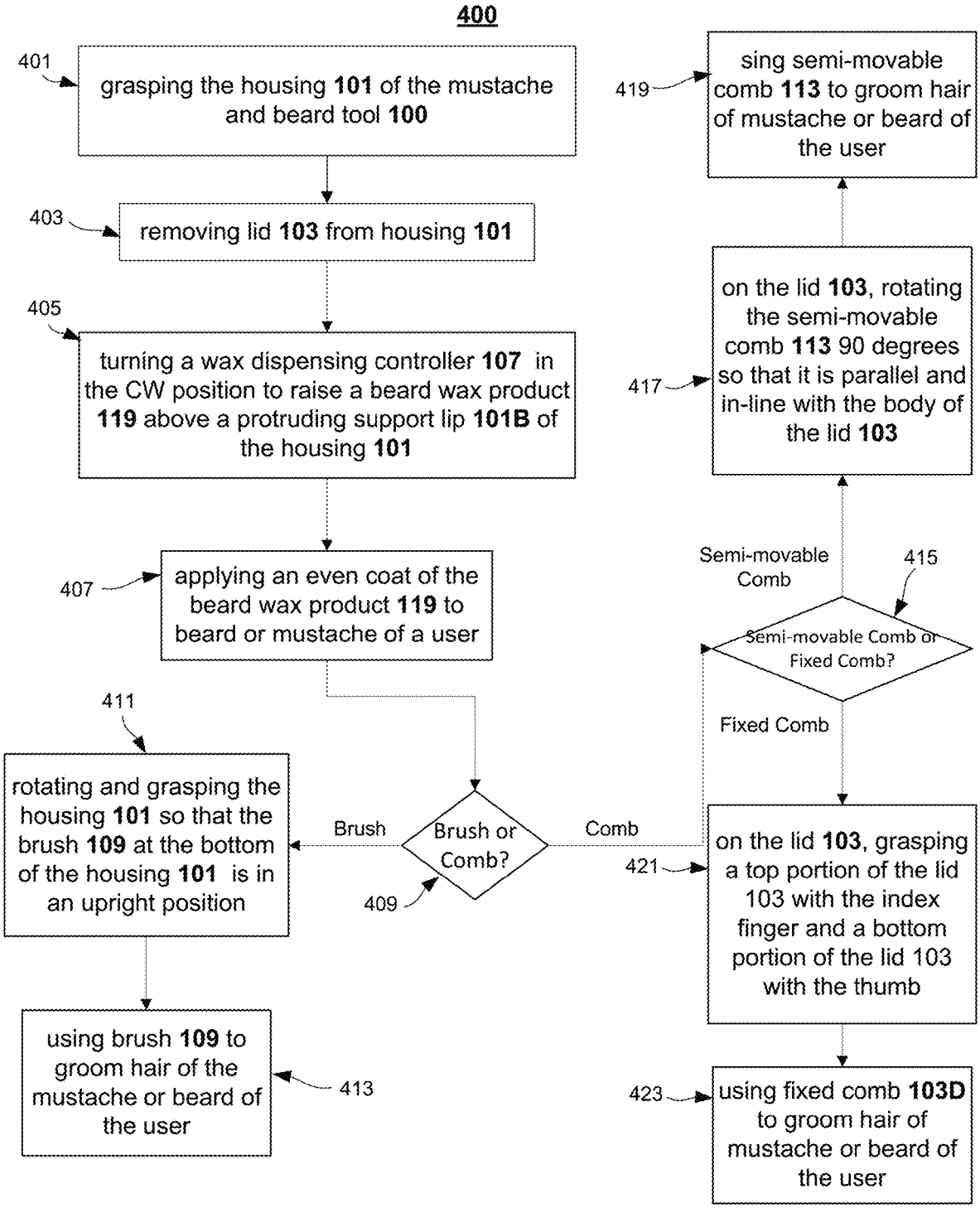
FIG. 35 illustrates a flowchart of using and applying the mustache and beard care tool in accordance to an embodiment.

FIG. 35 illustrates a flowchart 400 of using and applying the mustache and beard care tool 100 in accordance to an embodiment. The method for using and applying the mustache and beard care tool 100 may include the following steps:

a) Grasping the housing 101 of the mustache and beard tool 100 (Step 400)
b) Removing lid 103 from housing 101 (Step 403)
c) Turning a wax dispensing controller 107 of the housing 101 in the CW position to raise a beard wax product 119 above a protruding support lip 101B of the housing 101 (Step 405)
d) Applying an even coat of the beard wax product 119 to beard or mustache of a user (Step 407)
e) Deciding to use a brush 109 or a comb? (Step 409)
f) If brush 109 is selected, rotating and grasping the housing 101 so that the brush 109 at the bottom of the housing 101 is in an upright position (Step 411)
g) Using brush 109 to groom hair of the mustache or beard of the user (Step 413)
h) If comb is selected, then deciding to use the semi-movable comb 113 or the fixed comb 103D? (Step 415)
i) If semi-movable comb 113 is selected, on the lid 103, rotating the semi-movable comb 113 90 degrees so that it is parallel and in-line with the body of the lid 103 (Step 417)
j) Using semi-movable comb 113 to groom hair of mustache or beard of the user (Step 419)
k) If fixed comb 103D is selected, on the lid 103, grasping a top portion of the lid 103 with the index finger and a bottom portion of the lid 103 with the thumb (Step 421)
l) Using fixed comb 103D to groom hair of mustache or beard of the user (Step 423)

Figure 36:
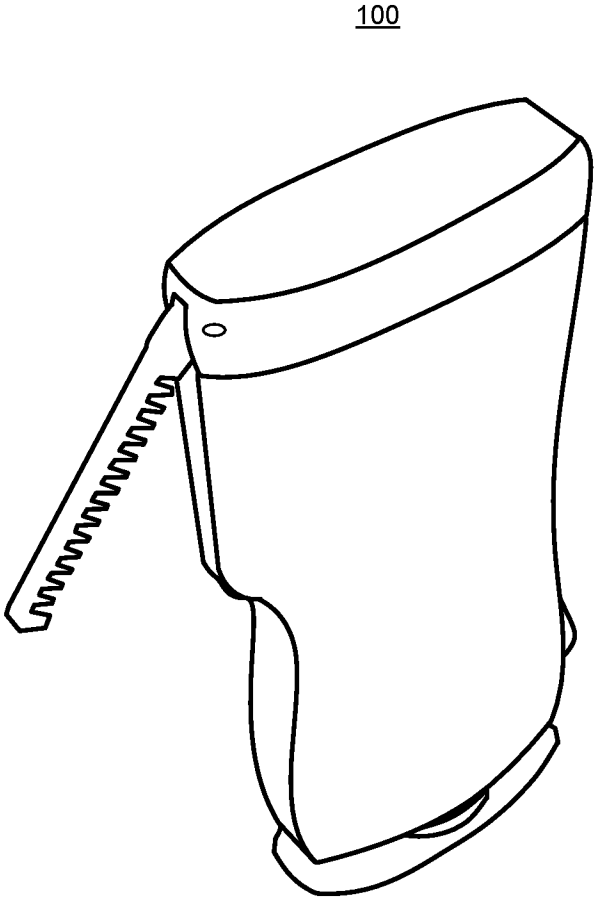
FIG. 36 illustrates a photograph of a prototype model of the mustache and beard care tool in accordance to an embodiment.

FIG. 36 illustrates a photograph of a prototype model of the mustache and beard care tool 100 in accordance to an embodiment. In some applications, the mustache and beard care tool 100 may be made to be a disposable product having non-replaceable components. In other applications, the mustache and beard care tool 100 is a non-disposable product having replaceable or interchangeable components which may include replaceable beard wax products, combs sizes and types, brushes, and lids.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is:

1. A mustache and beard care tool for grooming, maintaining and caring for a mustache or beard of a user, the mustache and beard care tool comprising:

a housing having a wall enclosure and a bottom portion, wherein a cavity is formed within the wall enclosure and the bottom portion, and a protruding lip formed at a top portion of the housing, wherein the cavity is configured to provide a space to receive a portion of a beard wax product;

a lid detachably coupled to the protruding lip of the housing;

a semi-movable comb, wherein the semi-movable comb is coupled to the lid;

a wax dispense assembly, wherein a portion of the wax dispense assembly is configured to support the beard wax product, wherein the beard wax product is composed of a solid wax or a paste material for sculpting or shaping the mustache or beard of the user, wherein the wax dispense assembly includes a control mechanism for dispensing the beard wax product; and a beard brush assembly coupled to the bottom portion of the housing.

2. The mustache and beard care tool of claim 1, wherein the semi-movable comb includes a pivot handle coupled to an elongated rectangular shaft having a single row of teeth, wherein the single row of teeth is formed along a lengthwise edge of the elongated rectangular shaft.

3. The mustache and beard care tool of claim 2, wherein the single row of teeth of the semi-movable comb includes a narrow size set of teeth, a medium size set of teeth, or a large size set of teeth.

4. The mustache and beard care tool of claim 1, wherein the wax dispense assembly includes a threaded wax dispensing rod having a bottom section and a series of threads along a lengthwise portion of the threaded wax dispensing rod, a wax dispensing support platform coupled to the series of threads of the threaded wax dispensing rod, and a wax dispensing controller coupled to the bottom section of the threaded wax dispensing rod.

5. The mustache and beard care tool of claim 4, wherein the beard brush assembly is connected to the wax dispensing controller and configured to rotate, wherein the beard brush assembly takes control of the control mechanism for dispensing the beard wax product by rotating the beard brush assembly in either a clockwise or counterclockwise direction.

6. The mustache and beard care tool of claim 1, wherein the housing includes two curved sides, the two curved sides having a smooth wave-like shape that is configured to conform to a grip of a hand of the user.

7. The mustache and beard care tool of claim 1, wherein the beard brush assembly includes a brush handle and a plurality of short teeth coupled to the brush handle.

8. The mustache and beard care tool of claim 1, wherein a mirrored surface is applied to a front face portion of the housing.

9. The mustache and beard care tool of claim 1, wherein the housing includes a scissors compartment formed on an exterior surface of the housing and configured to hold a pair of scissors.

10. The mustache and beard care tool of claim 1, wherein the mustache and beard care tool is a disposable product having a plurality of non-replaceable components.

11. The mustache and beard care tool of claim 1, wherein the mustache and beard care tool is a non-disposable product having a plurality of replaceable or interchangeable components, including replaceable beard wax products, replaceable or interchangeable comb sizes and types, replaceable or interchangeable brush assemblies, and replaceable or interchangeable lid assemblies.

12. A mustache and beard care tool for grooming, maintaining and caring for a mustache or beard of a user, the mustache and beard care tool comprising:

a housing having a wall enclosure and a bottom portion, wherein a cavity is formed within the wall enclosure and the bottom portion, and a protruding lip formed at a top portion of the housing, wherein the cavity is configured to provide a space to receive a portion of a beard wax product;

a lid detachably coupled to the protruding lip of the housing;

a semi-movable comb, wherein the semi-movable comb is coupled to the lid;

a fixed comb having a plurality of teeth distributed and formed on a portion of the lid;

a wax dispense assembly, wherein a portion of the wax dispense assembly is configured to support the beard wax product, wherein the beard wax product is composed of a solid wax or a paste material for sculpting or shaping the mustache or beard of the user, wherein the wax dispense assembly includes a control mechanism for dispensing the beard wax product; and a beard brush assembly coupled to the bottom portion of the housing.

13. The mustache and beard care tool of claim 12, wherein a plurality of comb channels are formed on a surface of the housing.

14. The mustache and beard care tool of claim 12, wherein the semi-movable comb includes a pivot handle coupled to an elongated rectangular shaft having a single row of teeth, wherein the single row of teeth is formed along a lengthwise edge of the elongated rectangular shaft.

15. The mustache and beard care tool of claim 14, wherein the single row of teeth of the semi-movable comb includes a narrow size set of teeth, a medium size set of teeth, or a large size set of teeth.

16. The mustache and beard care tool of claim 12, wherein the wax dispense assembly includes a threaded wax dispensing rod having a bottom section and a series of threads along a lengthwise portion of the threaded wax dispensing rod, a wax dispensing support platform coupled to the series of threads of the threaded wax dispensing rod, and a wax dispensing controller coupled to the bottom section of the threaded wax dispensing rod.

17. The mustache and beard care tool of claim 16, wherein the beard brush assembly is connected to the wax dispensing controller and configured to rotate, wherein the beard brush assembly takes control of the control mechanism for dispensing the beard wax product by rotating the beard brush assembly in either a clockwise or counterclockwise direction.

18. The mustache and beard care tool of claim 12, wherein the housing includes two curved sides, the two curved sides having a smooth wave-like shape that is configured to conform to a grip of a hand of the user.

19. The mustache and beard care tool of claim 12, wherein the mustache and beard care tool is a disposable product having a plurality of non-replaceable components.

20. The mustache and beard care tool of claim 12, wherein the mustache and beard care tool is a non-disposable product having a plurality of replaceable or interchangeable components, including replaceable beard wax products, replaceable or interchangeable comb sizes and types, replaceable or interchangeable brush assemblies, and replaceable or interchangeable lid assemblies.

* * * * *